US009599324B2

(12) United States Patent
Diekmann et al.

(10) Patent No.: US 9,599,324 B2
(45) Date of Patent: Mar. 21, 2017

(54) HOLDER ELEMENT FOR HOLDING AT LEAST ONE FLAT SURFACE-LIGHT LAMP, SET OF A PLURALITY OF LAMPHOLDERS AND A PLURALITY OF ELONGATE HOLDING BODIES AND LUMINAIRE

(75) Inventors: Karsten Diekmann, Rattenberg (DE); Stefan Gschloessl, Nittendorf (DE)

(73) Assignee: OSRAM OLED GMBH, Regensburg (DE)

( * ) Notice: Subject to any disclaimer, the term of this patent is extended or adjusted under 35 U.S.C. 154(b) by 0 days.

(21) Appl. No.: 14/347,642

(22) PCT Filed: Aug. 21, 2012

(86) PCT No.: PCT/EP2012/066254

§ 371 (c)(1),
(2), (4) Date: Mar. 27, 2014

(87) PCT Pub. No.: WO2013/056876

PCT Pub. Date: Apr. 25, 2013

(65) Prior Publication Data

US 2014/0233227 A1 Aug. 21, 2014

(30) Foreign Application Priority Data

Oct. 19, 2011 (DE) ..... 10 2011 084 814

(51) Int. Cl.
*F21V 21/02* (2006.01)
*F21V 17/12* (2006.01)
(Continued)

(52) U.S. Cl.
CPC ..... *F21V 21/02* (2013.01); *F21S 2/005* (2013.01); *F21S 8/03* (2013.01); *F21V 17/12* (2013.01);
(Continued)

(58) Field of Classification Search
CPC ..... F21V 21/005; F21V 21/00; F21S 8/03
See application file for complete search history.

(56) References Cited

U.S. PATENT DOCUMENTS 4,720,115 A * 1/1988 Rehrig ..... 280/79.11
6,565,231 B1 5/2003 Cok
(Continued)

FOREIGN PATENT DOCUMENTS

CN 102338295 A 2/2012
DE 20311557 U1 11/2003
(Continued)

OTHER PUBLICATIONS

International Search Report issued for PCT/EP2012/066254 mailed Oct. 16, 2012.
(Continued)

*Primary Examiner* — Jong-Suk (James) Lee
*Assistant Examiner* — Eric T Eide
(74) *Attorney, Agent, or Firm* — Viering, Jentschura & Partner mbB

(57) ABSTRACT

A holder element for holding at least one flat surface-light lamp includes: an elongate, flat plate body having an upper plate side and a lower plate side arranged opposite the upper plate side, and one or more lampholders, which can be fitted on the plate body, for mechanically holding and making electrical contact with a flat surface-light lamp, wherein an engagement portion is formed on each of the two longitudinal ends of the plate body and is formed by a cutout, which extends, in plan view, from the respective longitudinal end of the plate body over the entire width of the plate body in the direction toward the longitudinal center, such that the plate body can be connected at each of its two longitudinal ends to another, identically formed plate body so as to form
(Continued)

a form-fitting connection formed by the engagement portions of the adjacent plate bodies.

20 Claims, 20 Drawing Sheets

(51) Int. Cl.

| | |
|---|---|
| ***F21V 19/00*** | (2006.01) |
| ***F21S 2/00*** | (2016.01) |
| ***F21V 21/005*** | (2006.01) |
| ***F21S 8/00*** | (2006.01) |
| *F21Y 105/00* | (2016.01) |

(52) U.S. Cl.
CPC ..... *F21V 19/00* (2013.01); *F21V 21/005* (2013.01); *F21Y 2105/00* (2013.01); *F21Y 2115/15* (2016.08)

(56) References Cited

U.S. PATENT DOCUMENTS

| | | | | |
|---|---|---|---|---|
| 6,819,036 | B2 | 11/2004 | Cok | |
| 9,046,233 | B2 * | 6/2015 | Chen | F21S 2/005 |
| 2005/0007780 | A1 | 1/2005 | Feuerborn et al. | |
| 2006/0285361 | A1 | 12/2006 | Cok | |
| 2008/0253120 | A1 * | 10/2008 | Okimura | 362/249 |
| 2010/0203757 | A1 * | 8/2010 | Mostoller et al. | 439/510 |
| 2011/0013395 | A1 | 1/2011 | Melzner et al. | |
| 2011/0026238 | A1 * | 2/2011 | Kim | 362/84 |
| 2011/0058373 | A1 * | 3/2011 | Newman | 362/249.02 |
| 2011/0222293 | A1 | 9/2011 | Kim et al. | |

FOREIGN PATENT DOCUMENTS

| | | | |
|---|---|---|---|
| DE | 60306721 | T2 | 7/2007 |
| DE | 60306720 | T2 | 8/2007 |
| DE | 102007044566 | A1 | 3/2009 |
| DE | 102010014611 | A1 | 10/2011 |
| DE | 202010004807 | U1 | 11/2011 |
| EP | 2280212 | A1 | 2/2011 |
| JP | 2006261039 | A | 9/2006 |
| JP | 2011044360 | A | 3/2011 |
| JP | 2011070923 | A | 4/2011 |
| JP | 2011070970 | A | 4/2011 |
| WO | 2005015077 | A1 | 2/2005 |
| WO | 2011058486 | A2 | 5/2011 |

OTHER PUBLICATIONS

International Preliminary Report on Patentability issued for PCT/EP2012/066254 on Apr. 22, 2014.
Chinese Office Action based on Application No. 201280051790.5(5 Pages) dated Jun. 17, 2016 (Reference Purpose Only).
Japanese Search Report based on Application No. 2014-536156(9 Pages and 12 pages of English translation) dated Mar. 12, 2015 (Reference Purpose Only).
Japanese Decision to Grant based on Application No. 2014-536156(3 Pages and 2 pages of English translation) dated Mar. 16, 2015.

* cited by examiner

HOLDER ELEMENT FOR HOLDING AT LEAST ONE FLAT SURFACE-LIGHT LAMP, SET OF A PLURALITY OF LAMPHOLDERS AND A PLURALITY OF ELONGATE HOLDING BODIES AND LUMINAIRE

RELATED APPLICATIONS

The present application is a national stage entry according to 35 U.S.C. §371 of PCT application No. PCT/EP2012/066254 filed on Aug. 21, 2012, which claims priority from German application No. 10 2011 084 814.2 filed on Oct. 19, 2011, and is incorporated herein by reference in its entirety.

TECHNICAL FIELD

Various embodiments relate to a holder element for holding at least one flat surface-light lamp, a set of a plurality of lampholders and a plurality of holding bodies and also a luminaire.

BACKGROUND

The need for two-dimensional lamps or two-dimensional luminaires, which are composed of a plurality of two-dimensional lamps, is increasing. Such surface luminaires are mounted for illumination on walls or ceilings, for example, and are of interest due to their lighting characteristics and the visually appealing overall impression on the one hand and the low power consumption on the other hand.

Luminaires formed from an OLED illuminant and a lampholder are known in the prior art. For example, DE 603 06 720 T2 discloses a lamp with an organic two-dimensional luminous layer arranged on a substrate. The substrate is plate-like and, on a narrow side, has a laterally/peripherally protruding tongue with electric conductive tracks. With the aid of this tongue, the substrate can be inserted into a corresponding insertion opening in a lampholder (referred to there as a lighting fixture) and can be contacted via the conductive tracks (there, see FIGS. 2A, 2B and 3, for example). Here, a plurality of openings may be formed in a single lampholder (there: illumination fixture) formed in one piece, a lamp being insertable via its tongue portion into each of said openings. Two-dimensional mounting on a wall or ceiling with lamps or lamp luminous areas arranged laterally side by side is difficult here. It has also been found that an exact alignment of the substrates in a common plane side by side with such a connection between the lampholder and illuminant cannot always be implemented with the desired accuracy.

Further connection possibilities between illuminant and lampholder are specified in DE 603 06 721 T2. For example, stirrup-shaped lampholders can also be used, which grasp around the substrate at two opposed points. The electrical contacting between the stirrup-shaped lampholder and the illuminant is achieved here via the conductors provided on a flat side of the substrate or via two substrate tongues provided on opposite narrow sides and having respective electrical conductors. Such a luminaire also fails to satisfy all requirements of simple and accurate mountability and the desired aesthetic impression.

SUMMARY

In various embodiments, a simpler, yet more reliable modular design of a luminaire is enabled, said luminaire having a plurality of flat surface-light lamps.

Various embodiments of the disclosure may enable a simple/uncomplicated, yet reliable design of a luminaire formed from a plurality of separate illuminant or lamps, of which the luminous areas form a total luminous area of the luminaire.

Various embodiments may enable an arrangement of the lampholders at defined distances from one another, for example. As a result, the surface-light lamps to be mounted on the lampholders may also be mounted peripherally at defined distances from one another or adjacently to one another in a luminaire, such that a surface-light luminaire can be formed from the surface-light lamps. The surface-light luminaire can be fitted to a wall or a ceiling, for example. The surface-light lamps may have planar luminous areas, for example, which lie/are arranged in the luminaire in a common plane.

In accordance with various embodiments of the disclosure, the lampholders here may be fastened already/subsequently to the holding bodies at defined, predetermined positions (for which purpose holes, in particular screw holes, can be designed to receive corresponding fastening elements on the holding bodies, for example), wherein the holding bodies themselves can be interconnected in a predetermined number of different possible arrangements. The holding bodies, for example, may first be arranged with respect to one another via their longitudinal ends and mechanically fixedly interconnected, then the lampholders can be fastened to the holding bodies, and next the lamps can be plugged via their underside onto the lampholders.

Various embodiments therefore create the possibility of integrating a plurality of separate flat surface-light lamps, such as flat OLED lamps or flat OLED modules (for example in the form of what are known as OLED plates or OLED tiles), in a variable arrangement, yet at a defined distance from one another and/or in a defined arrangement with respect to one another in luminaire systems.

Various embodiments create the possibility of connecting a plurality of separate flat surface-light lamps in a simple and quick, yet reliable manner so as to form a flat surface-light arrangement.

In accordance with various embodiments, a luminaire may include:

- a plurality of lampholders for mechanically holding and electrically contacting a surface-light lamp in each case,
- a plurality of flat surface-light lamps having a respective upper flat side, which includes a luminous area, and a respective underside, which is arranged opposite the upper flat side,
- wherein each lampholder is associated with a surface-light lamp and each surface-light lamp, on its underside, in order to establish a mechanical and electrical connection to the associated lampholder, is designed such that the respective surface-light lamp can be attached via its underside to the respective lampholder, thus making the electrical contact, and
- a plurality of (separate) elongate holding bodies, which, via their longitudinal ends, can be mechanically fixedly interconnected or are mechanically fixedly interconnected so as to form a holding structure, which is composed of the holding bodies and to which the lampholders can be fitted or are fitted at regular distances from one another on a common holding structure side.

During operation or in the installed/mounted state, the respective upper flat side may be oriented downwardly here for example, such that the surface-light lamp (for example an OLED) is formed as what is known as a "bottom emitter". In the mounted state of the luminaire/surface-light lamp, the luminous side formed by the upper flat side therefore must not point upwardly, but for example may point downwardly or may arranged vertically or may be arranged in a manner inclined with respect to the vertical.

In various embodiments, the holding bodies are interconnectable/interconnected in predetermined arrangements with respect to one another via matching holding body connection portions formed on their longitudinal ends.

In various embodiments, a plurality of lampholder fastening portions may be formed on the holding structure formed by the holding bodies, and the lampholders may be fastened to said lampholder fastening portions, for example detachably, for example by means of a screw connection, for which purpose corresponding screw holes may be formed in the holding bodies.

The luminaire may be formed, for example, as a wall surface luminaire or ceiling surface luminaire.

The lampholders may be formed as plug-on lampholders, for example, that is to say the surface-light lamps can be plugged onto or are plugged onto the respective lampholders without the use of tools.

The respective flat surface-light lamp may have a thickness which is much smaller than the extension of the surface-light lamp in the length and width direction (or in the radial direction). For example, the extension of the surface-light lamp in the length and width direction may in each case be at least 10 times greater than the extension in the thickness direction. The upper flat side of the respective surface-light lamp or the luminous area thereof may be planar or alternatively slightly curved, for example.

The respective surface-light lamp, for example in a central region of its underside, can be contacted with the lampholder. The respective lampholder may be covered, for example completely, by the upper side of the respective surface-light lamp (and in particular by the luminous area) in plan view when the surface-light lamp is mounted on the respective lampholder. The dimensions of the respective lamp in the width and length direction may thus be greater than those of the respective lampholder. In other words, the respective lampholder may be completely covered by the associated surface-light lamp in the mounted state of the surface-light lamp, as viewed from the luminous area of the surface-light lamp. The upper side of the respective surface-light lamp may be substantially parallel here to the upper side of the respective lampholder.

For example, the respective surface-light lamp may be a flat LED lamp or a flat OLED lamp (OLED stands for organic light-emitting diode), in particular what is known as an OLED plate or OLED tile, in particular a rectangular or square OLED plate or OLED tile (alternatively however, the OLED lamp may also have an oval or circular shape). The respective surface-light lamp may have a two-dimensional, continuous luminous layer or luminous layer arrangement, for example. The respective surface-light lamp may be or may include a plate-like or sheet-like OLED or a plate-like or sheet-like LED or an EL film, for example. Generally, a plurality of the surface-light lamps or all of the surface-light lamps may have a square periphery or a rectangular periphery, for example, or an octagonal, hexagonal or triangular periphery, or an oval periphery or a circular periphery.

In the above luminaire, the respective flat surface-light lamp may be an illuminant, which includes:

a plate-like or sheet-like carrier element, which includes or carries (at least) one semiconductor luminous element, which is two-dimensional in particular, or is part of a semiconductor luminous element, which is two-dimensional in particular, and also an illuminant housing, in which the carrier element is received and which, on its front side, includes a light exit opening for radiating light, and which, on its rear side opposite the front side, includes an illuminant connection device for establishing a mechanical and electrical connection to an associated lampholder.

In principle, all two-dimensional semiconductor luminous elements can be considered as a semiconductor luminous element. For example, the semiconductor luminous element may have an organic luminous layer, which is arranged between two electrodes (anode and cathode). For example, the semiconductor luminous element may be an organic light-emitting diode, which is attached flat in a number of layers to a carrier surface of the carrier element. The length and width of the film-like or plate-like carrier element are 10 times greater than its thickness, for example. The carrier element can be formed in a number of layers and, for example, may include two glass plates, between which the semiconductor luminous element is arranged.

The illuminant housing can be produced, for example, from an electrically insulating material. Contact protection is thus formed, such that the illuminant can be used both for low-voltage luminaires and for high-voltage luminaires.

The illuminant connection device may be provided, for example, in a central region of the housing rear side.

Alternatively or additionally, the respective lamp housing or illuminant housing in the above luminaire may have a cutout, for example on its rear side, in which the associated lampholder can engage when the mechanical connection is established or in which the associated lampholder is as least partially received when the mechanical connection is established. Here, the illuminant connection device may be arranged in the cutout. It is thus possible to improve the contact protection at the connection point between the illuminant and the lampholder, and additionally to achieve a flat design for a surface luminaire. The cutout may be formed centrally in the rear side of the housing, for example.

Alternatively or additionally, the illuminant connection device in the above luminaire may be symmetrical with respect to a point of symmetry or an axis of symmetry on the rear side, for example.

Alternatively or additionally, the illuminant connection device in the above luminaire may include a detent means and/or a plug-in means for establishing a mechanical connection to the lampholder, for example. Here, the illuminant may be latched or plugged onto the lampholder preferably at right angles to the plane of its preferably planar luminous area. The illuminant is mounted and replaced particularly easily here, and in particular without tools. The plug-on force and/or removal force when establishing or detaching the connection respectively between the illuminant and the lampholder may be predetermined by the shape and/or size of a latching protrusion of the detent means.

Alternatively or additionally, the illuminant connection device in the above luminaire may include a coding device having at least one coding element, for example, so as to predefine at least one admissible relative position of the illuminant with respect to the lampholder when establishing the connection.

Alternatively or additionally, the illuminant housing in the above luminaire may include a frame surrounding the light exit opening and a housing rear wall including the rear side, for example. Here, the frame may rest against a light radiation side of the carrier element, for example via a bearing surface. In addition, resilient bearing elements for example may be provided between the carrier element and the housing rear wall and press the carrier element against the bearing surface on the frame.

Alternatively or additionally, the illuminant connection device in the above luminaire may include electric illuminant connection points, for example, which are accessible on the rear side of the housing and may be provided in addition to the detent means and/or plug-in means.

Alternatively or additionally, semiconductor contact surfaces, which are electrically connected either to the anode or the cathode of the semiconductor luminous element, may be provided in the above luminaire on the carrier element, for example. The semiconductor contact surfaces may be provided here, for example, on the side opposite a light radiation side of the carrier element. The semiconductor contact surfaces may be arranged within the electrically insulating illuminant housing, whereby they are safeguarded against contact. Here, any illuminant attachment point may be connected, for example electrically, to an illuminant contact, which bears against one of the semiconductor contact surfaces. Furthermore, an electrically conductive illuminant contact part may be provided, which includes one of the illuminant attachment points and one of the illuminant contacts. The above bearing elements may be formed, for example, by spring zones of the illuminant contact part.

The carrier element may include, for example, two semiconductor luminous elements, each having two semiconductor contact surfaces.

The light exit opening may delimit a planar luminous area of the illuminant, for example.

The luminous areas, which for example are formed in a planar manner, of the illuminant or lamps arranged on the lampholders may lie or may be arranged in a common plane. Here, the surface-light lamps, in the assembled state, may bear peripherally/laterally against one another for example, such that they produce a continuous planar total luminous area.

In accordance with a second embodiment of the disclosure, a set of a plurality of lampholders and a plurality of elongate holding bodies may be provided. The lampholders are used here to mechanically hold and electrically contact a flat surface-light lamp in each case. The elongate holding bodies are mechanically fixedly interconnectable or mechanically fixedly interconnected, in particular in predetermined arrangements with respect to one another, via matching holding body connection portions formed on the longitudinal ends of the holding bodies so as to form a holding structure, which is composed of the holding bodies and to which the lampholders can be fitted or are fitted (in particular via lampholder fastening portions formed on the holding bodies) at regular distances on a common holding structure side.

The holding body connection portions may include, for example, complementary engagement portions, which are formed on the longitudinal ends and which can be interconnected in a form-fitting manner, and/or matching connection elements formed on the longitudinal ends for forming a form-fitting and force-fitting connection, such as aligned through-holes for receiving a fastening element. This is true similarly for the first embodiment.

The holding structure formed by the holding bodies may be flat, for example, with a planar upper flat side and/or a planar lower flat side. In particular, the common holding structure side to which the lampholders can be fitted/are fitted, can be level, such that the lampholders, in the mounted state (and consequently also the lamps to be fastened thereto), lie in a common plane.

The mechanically fixed connection of the elongate holding bodies via their longitudinal ends can be produced with use of mechanical fastening means (for example screws). Here, the mechanical fastening means may produce, for example, a form-fitting and/or force-fitting connection, for example a screw connection or pin connection or rivet connection. The connection may be a detachable connection, for example a plug connection and/or a detent connection and/or a screw connection and/or a clamp connection.

Both in the first and in the second embodiment, the lampholders may be formed integrally with the holding bodies or alternatively as components separate from the holding bodies, for example.

If the lampholders are formed as separate components, they may thus each include a lampholder housing, wherein the respective lampholder housing, on its side facing the illuminant or the lamp, includes a connection side, on which a lampholder attachment device is provided, which serves to establish a mechanical and electrical connection to an associated surface-light lamp, and wherein the respective lampholder housing further includes a mounting side opposite the connection side for fastening the lampholder to the holding structure. Here, the respective lampholder may be formed, for example, as a flat component, the two flat sides of which form the connection side and the mounting side.

For example, end-face lampholder housing sides may extend between the connection side and the mounting side of the lampholder housing, wherein supply attachment points for electrically connecting the lampholder to a supply line are provided at least on one of the end-face lampholder housing sides. For example, a plurality of supply attachment points may be provided on a plurality of lampholder housing sides. A strain relief means may be provided for each supply attachment point, for example. The strain relief means may be fastened, for example detachably, to the lampholder housing. The supply attachment points may have either a positive polarity (+) or negative polarity (−), and all supply attachment points having the same polarity (+ or −) can be electrically short-circuited to one another. On a lampholder housing side with supply attachment points, at least one supply attachment point may be associated with the positive pole and at least one supply attachment point may be associated with the negative pole in each case. In the lampholder housing, short-circuit connectors may be arranged, which have a plurality of attachment point surfaces, wherein one of the attachment point surfaces of the same short-circuit connector is associated with each supply attachment point to be short-circuited.

The lampholder attachment device may include electrical lampholder connections, for example, which are used for electrical connection to the illuminant. A plurality of lampholder connections of identical polarity (+ or −) may be provided in each case, and the lampholder connections of identical polarity (+ or −) can be electrically short-circuited to one another. The electrical short circuit between lampholder connections of identical polarity (+ or −) can be implemented in each case by a single short-circuit connector. A short-circuit connector associated with the negative pole (−) and a short-circuit connector associated with the positive pole (+) may be provided and have an identical form. Each short-circuit connector may include a base portion and connection parts, which are bent from the base portion and each have an attachment point surface. The short-circuit connectors associated with the two different poles (+ or −) can be arranged in the lampholder housing at an insulation distance. The base portions of the two short-circuit connectors may cross one another at a point of intersection, whilst maintaining the insulation distance.

Within the context of this description and in the above embodiments, a lampholder may be understood, for example, to mean an apparatus or a component to which a replaceable lamp can be mechanically fastened (or detached therefrom) quickly and in an uncomplicated manner in order to simultaneously electrically contact the lamp and therefore so as to supply the lamp with electric current. In other words, the electrical contacting of the lamp, that is to say the connection of the power lines or electrical contacts thereof, can be implemented simultaneously by the mechanical fastening of the lamp to the lampholder. The lampholder and the lamp may be formed in such a way that the lamp can be fastened to the lampholder without tools and detachably, for example by plugging the lamp onto the lampholder. In other words the lampholder may be a plug-type lampholder, onto which the lamp can be plugged.

In the above embodiments, the elongate holding bodies can be produced, for example, from metal or alternatively from a suitable plastic material.

In the above embodiments, the elongate holding bodies are used in particular as spacers, which keep the lampholders at defined or regular distances from one another. In other words, the holding bodies enable an arrangement of the lampholders (and therefore of the lamps or illuminants) at defined distances from one another.

Alternatively or additionally, the lampholders in the above embodiments may therefore be fitted or can be fitted, for example detachably, to predetermined lampholder fastening portions, which are formed on a plurality of holding bodies or on all holding bodies, for example by means of a plug connection and/or a detent connection and/or a screw connection. For example, all of the holding bodies or a plurality of the holding bodies may have a formed lampholder fastening portion on a common retaining body side on their respective longitudinal end, such that a total of two lampholders can be fitted to a respective holding body. The respective lampholder fastening portion may include one or more holes formed on the respective longitudinal end for receiving a fastening element, for example.

Alternatively or additionally, the elongate holding bodies in the two embodiments above may be formed completely identically, for example, that is to say have the same shape and the same dimensions. Alternatively, merely the longitudinal ends of the holding bodies may be formed identically, for example.

Alternatively or additionally, the elongate holding bodies in the above embodiments may, for example, be detachably mechanically fixedly interconnected (for example screwed) or connectable at their longitudinal ends. The detachable connection may be a screw connection, for example. In other words, the holding bodies may be fixedly interconnected with use of a detachable connection element. Alternatively, the holding bodies may also be riveted however, for example. Further alternatively, the elongate holding bodies may also be integrally bonded to one another, for example adhesively bonded.

Alternatively or additionally, the elongate holding bodies in the above embodiments may be interconnected or interconnectable in a form-fitting manner at their longitudinal ends via engagement portions formed in a complementary manner. The engagement portions may therefore supplement one another or cooperate with one another, whereby a limited number of different possible arrangements relative to one another may be predetermined. The engagement portions may be formed, for example, by indentations or cutouts formed on the two longitudinal ends of a holding body. The two cutout engagement portions may be formed identically. For example, the respective cutout in plan view may be rectangular, in particular square. The cutouts may be formed on a common side or on opposite sides of the holding body. In other words, the two longitudinal ends of any holding body may have tabs or connection tongues, wherein, for the connection of two holding bodies, the tabs of the adjacent longitudinal ends are placed one above the other, such that they overlap one another, in particular completely. If two adjacent holding bodies are placed one above the other via their cutouts or tabs, the form fit can thus be formed, for example by three surface pairs, for example by a horizontal surface pair and two vertical surface pairs (wherein the two vertical surface pairs may be arranged parallel or perpendicular to one another depending on whether the holding bodies are arranged linearly or at right angles to one another).

For example, the elongate holding bodies may be connected at their longitudinal ends both by a detachable connection (with use of a detachable fastening element, such as a screw) and by a (purely) form-fitting connection, which is achieved by the complementary engagement portions.

Alternatively or additionally, two adjacent holding bodies in the above embodiments may be connected or connectable in either a linear or right-angled arrangement relative to one another. For example, the holding bodies are interconnected via their longitudinal ends exclusively in these two arrangements. In other words the holding bodies may be interconnectable via their longitudinal ends in a predetermined number of different orientations. The described, defined/predetermined arrangement of the holding bodies may be achieved/facilitated in particular by the above-described form fit. By arranging a plurality of holding bodies in a row, the following holding structures can be achieved here, for example: linear holding structure, right-angled or L-shaped holding structure, U-shaped holding structure, rectangular or square holding structure, meandering holding structure, zigzag-shaped holding structure or serpentine holding structure.

Alternatively or additionally, the elongate holding bodies in the above embodiments may be formed as flat plate bodies with a plate underside and a plate upper side. Here, the plate bodies may have a strip form, for example. For example, the plate bodies have a rectangular form (in plan view). The strip portion arranged centrally in the longitudinal direction may also be tapered however, for example.

The respective plate underside may be formed in a planar manner, for example.

With one or more or all of the plate bodies, one or more holes with an inner thread may be provided on the plate underside at the two longitudinal ends. The lampholders may then be attached already or subsequently to the plate undersides with use of screws. Here, the screws may extend through corresponding holes in the lampholders and may engage in the respective inner thread. The respective hole may be a blind hole or through-hole, for example. For example, a group of a plurality of through-bores may be provided in each case, for example a group formed from four through-holes.

Alternatively, the lampholders may also be connected to the plate underside by means of other connection techniques however. For example, the lampholders may be adhesively bonded or latched or plugged via their mounting side onto the plate underside.

In addition or alternatively, the respective plate body may have a cutout on each of its two longitudinal ends. For example, the cutouts may both be formed on the plate upper side. The respective cutout may extend over the entire plate width from the respective longitudinal end in the direction of the center of the plate (but not as far as the center of the plate, that is to say at a distance from the center of the plate as arranged in the longitudinal direction of the plate). The respective cutout forms an engagement portion for engagement with the cutout of another plate body. The respective cutout, in plan view, may be formed in a rectangular manner, in particular a square manner, for example. The respective cutout may extend in the depth direction or thickness direction, for example as far as the center of the plate. Two adjacent holding bodies may then be arranged one above the other via their sunken regions formed by the cutouts, in such a way that the upper plate side of one holding body is aligned with the lower plate side of the other holding body or lies in a common plane. A protrusion with a planar surface may be formed between the cutouts. The cutouts are formed identically in particular.

At least one through-hole may be arranged in the base of the respective cutout or in the tab formed by the cutout. For example, a centrally arranged through-hole is provided in the base of the respective cutout. For example, the at least one through-hole or the wall thereof is provided with an inner thread. Two adjacent holding bodies can be placed with their cutouts/tabs one above the other and fixedly interconnected with use of a fastening means, which extends through the two aligned through-holes. The fastening means may be a screw, for example (or alternatively a rivet for example). At least in one of the two cutouts of any holding body, the at least one through-hole on the plate underside may lead into a depression, such that the fastening means (or screw head or rivet head thereof) may rest in the depression flush with the plate underside. For example, a plurality of holes with inner thread for fastening a lampholder may be arranged on the plate underside around the through-hole for connection of two holding bodies (for example symmetrically around the through-hole).

Optionally, in the above embodiments, a through-hole may be provided in a region, which is central in the longitudinal direction of the plate, of at least one plate body (in particular of a plurality of plate bodies or all plate bodies), such that the at least one plate body can be mounted on a fastening surface (for example on a ceiling or a wall) with use of a mechanical fastening element (for example a screw), which extends through the through-hole.

Furthermore, in each of the above embodiments, a plate-shaped termination piece may be provided. This may be helpful in particular with an even number of holding bodies. Here, the termination piece may be formed in a manner complementary to one of the above-described cutouts on the longitudinal ends of the respective holding body. In other words, the cutout may be filled completely by the termination piece, such that a planar surface is produced when the termination piece is mounted on the longitudinal end. Here, the termination piece may include holes for the fastening of the lampholder, and may include a through-hole, which is aligned with the through-hole formed in the tab/cutout for connection of the holding body.

In accordance with various embodiments, a holder element for holding at least one flat surface-light lamp may include:

an elongate, flat plate body having an upper plate side and a lower plate side arranged opposite the upper plate side, and also at least one lampholder, which can be fitted or is/are fitted on the plate underside or plate upper side, for mechanically holding and making electrical contact with a flat surface-light lamp, wherein an engagement portion is formed on each of the two longitudinal ends of the plate body and is formed by a cutout, which extends, in plan view, from the respective longitudinal end of the plate body over the entire width of the plate body in the direction toward the longitudinal center, such that the plate body can be connected at each of its two longitudinal ends to another, identically formed plate body so as to form a form-fitting connection formed by the engagement portions of the adjacent plate bodies.

The elongate holding body and/or the lampholder may be formed here as described for the above-described embodiments.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which.

DETAILED DESCRIPTION

In the following detailed description, reference is made to the accompanying drawings, which form part of this description and in which specific embodiments in which the disclosure can be implemented are shown by way of illustration. In this respect, terms relating to directions, such as "above", "below", "in front of", "behind", "front", "rear", etc. will be used with reference to the orientation of the described figure(s). Since components of embodiments can be positioned in a number of different orientations, the terms regarding direction are used for illustration and are in no way limiting. It goes without saying that other embodiments can be used and structural or logical modifications made without departing from the scope of protection of the present disclosure. It goes without saying that the features of the different embodiments described herein can be combined with one another, unless specifically stated otherwise. The following detailed description therefore is not to be interpreted in a limiting sense, and the scope of protection of the present disclosure is defined by the accompanying claims.

Within the scope of this description the terms "connected", "attached" and "coupled" are used to describe both a direct and an indirect connection, a direct or indirect attachment and also a direct or indirect coupling. Identical or similar elements are provided with identical reference signs in the figures where expedient.

Figure 11A:
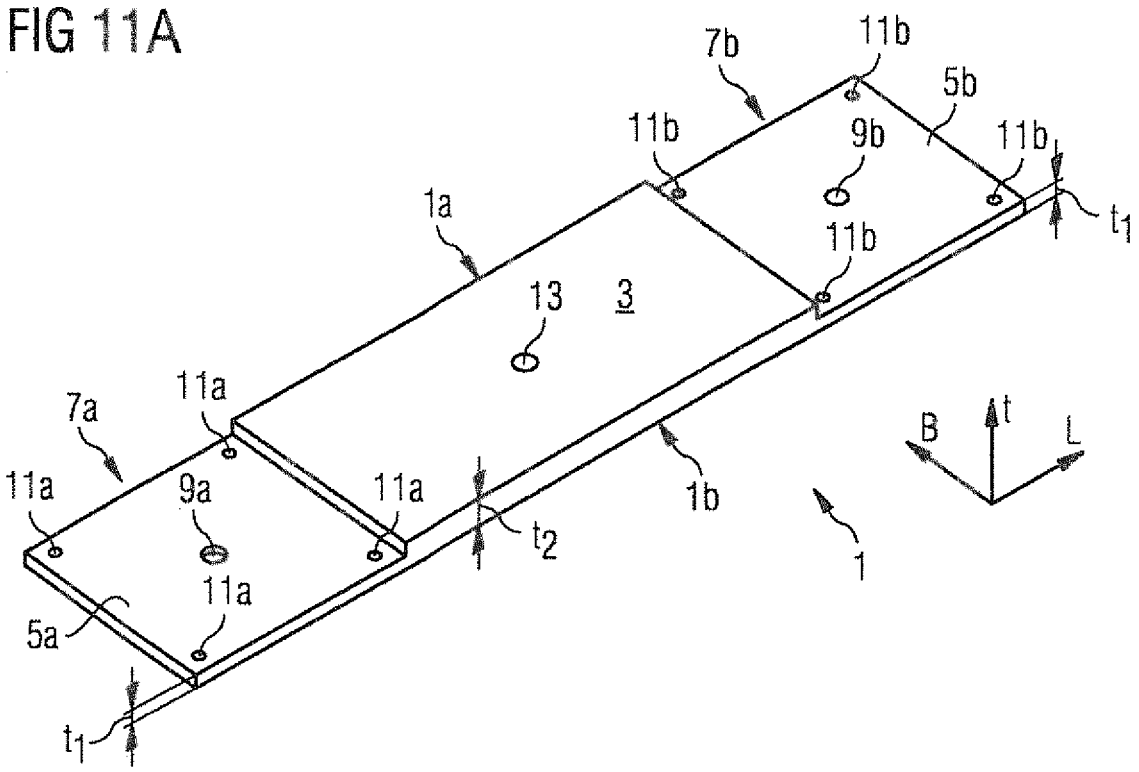
FIG. 11A shows a plan view of a holding body in accordance with an embodiment of the disclosure.
Figure 11B:
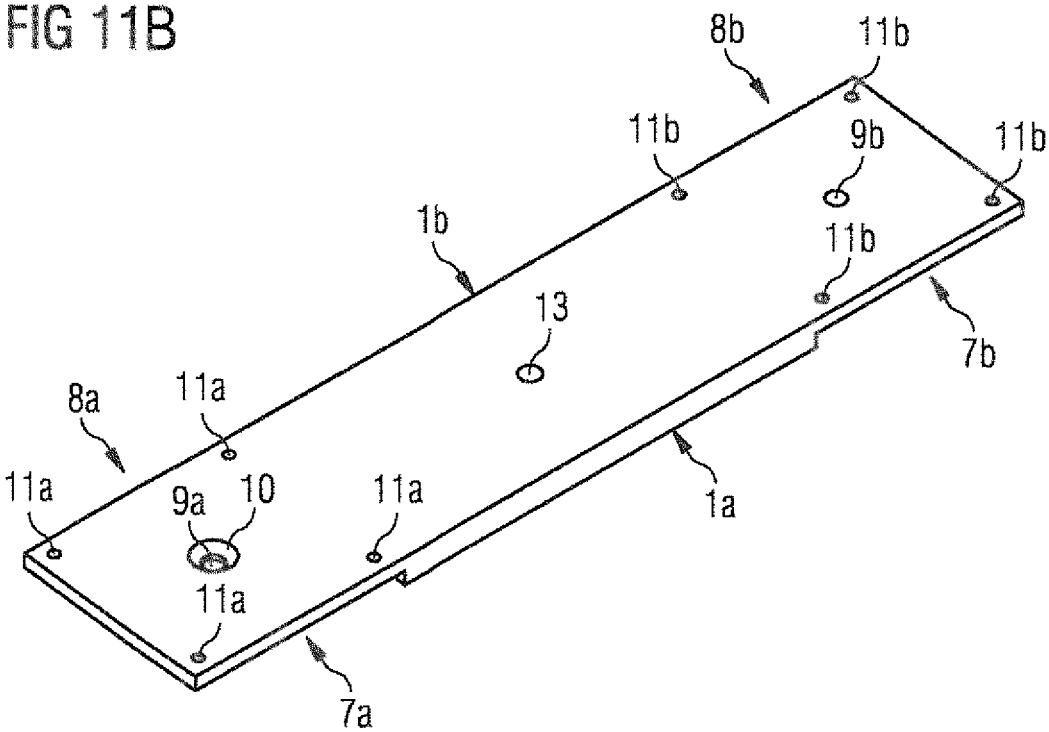
FIG. 11B shows a view from below of the holding body from FIG. 11A.

A lampholder and a lamp/illuminant and also a luminaire composed thereof are shown in FIGS. 1 to 10 and are suitable for use with/in the present disclosure. However, the disclosure can also be implemented with other lampholder/lamp systems. In other words, a holding body as is described below with reference to FIGS. 11A and 11B is also used for example together with other lamps and/or other lampholders.

Figure 1:
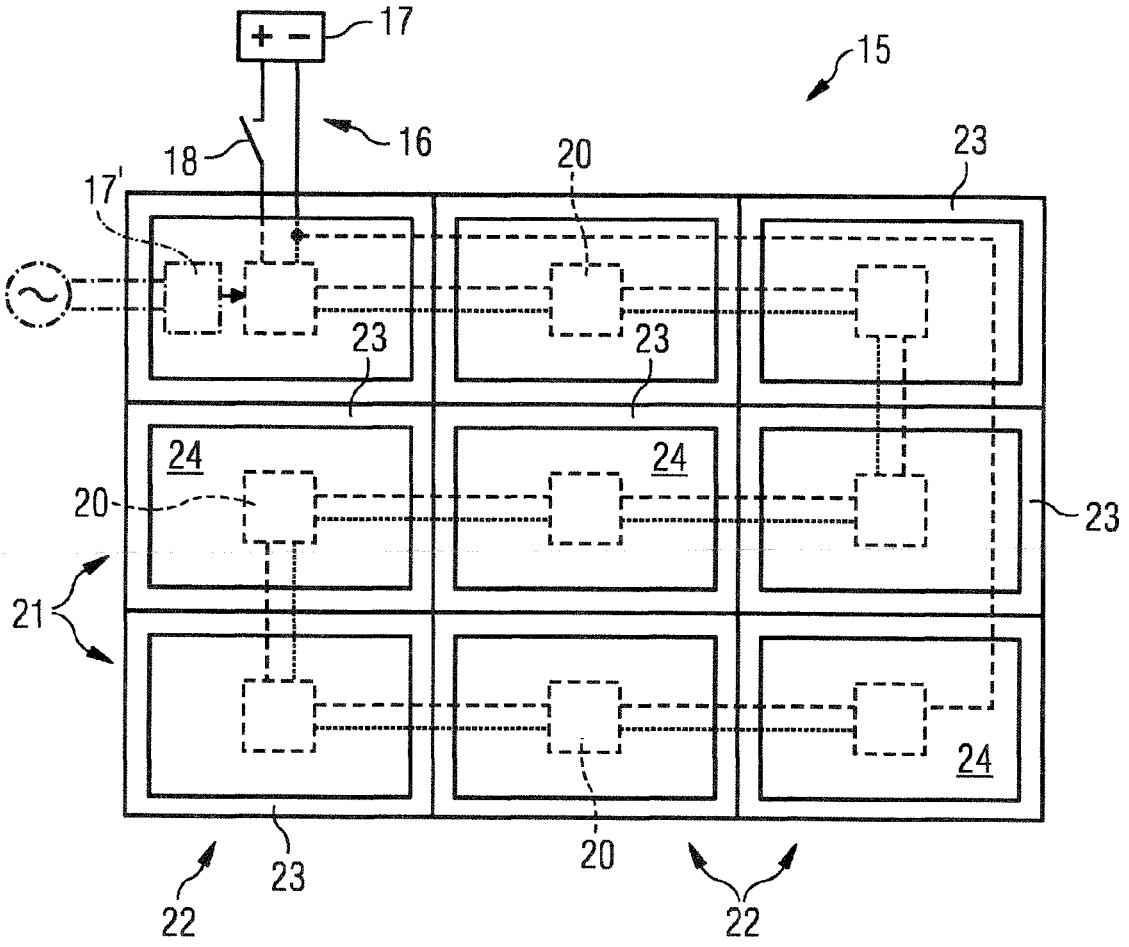
FIG. 1 shows a schematic illustration of a luminaire with a plurality of lamps or illuminants and a plurality of lampholders.

FIG. 1 shows a schematic illustration, similar to a block diagram, of a luminaire 15, which is attached via a supply line 16 to a voltage source 17. The voltage source 17 provides a DC voltage for powering the luminaire 15. For example, a ballast may serve as a voltage source 17. Here, a switch 18 is provided in the supply line 16 merely symbolically and serves to switch on and off the luminaire 15. Instead of a voltage source 17, a current source 17' could also be used, as is illustrated schematically by a dot and dash line. The current source 17' may be part of a ballast. The current source 17' may also be arranged as a current driver within the lampholder 20 and may be connectable to the conventional voltage supply system. The lampholders 20 are preferably connected in series to the current source 17'.

The luminaire 15 includes at least one lampholder 20. In the embodiment according to FIG. 1, a plurality of lampholders 20 are provided and are arranged in a matrix-like manner at regular distances from one another in a number of rows 21 and a number of columns 22. Each lampholder 20 is both mechanically connected and electrically connected to an illuminant 23. In the embodiment, the illuminants 23 are rectangular. The luminous areas 24 of the illuminants 23 form a common total luminous area of the luminaire 15. Here, they preferably abut one another at the longitudinal edge or the transverse edges. The distance between the lampholders 20 is determined accordingly. To connect an illuminant 23 to a lampholder 20, said illuminant is plugged or latched onto the associated lampholder 20, without tools, in the plug-on direction at right angles to its luminous area 24. The illuminant 23 can also be removed from the lampholder 20, preferably without tools, in the opposite removal direction.

FIGS. 1 to 10 on the one hand concern the design of the illuminant 23 and on the other hand concern the design of the lampholder 20. The lampholder 20 and the illuminant 23 can be combined to form a luminaire 15.

Figure 2A:
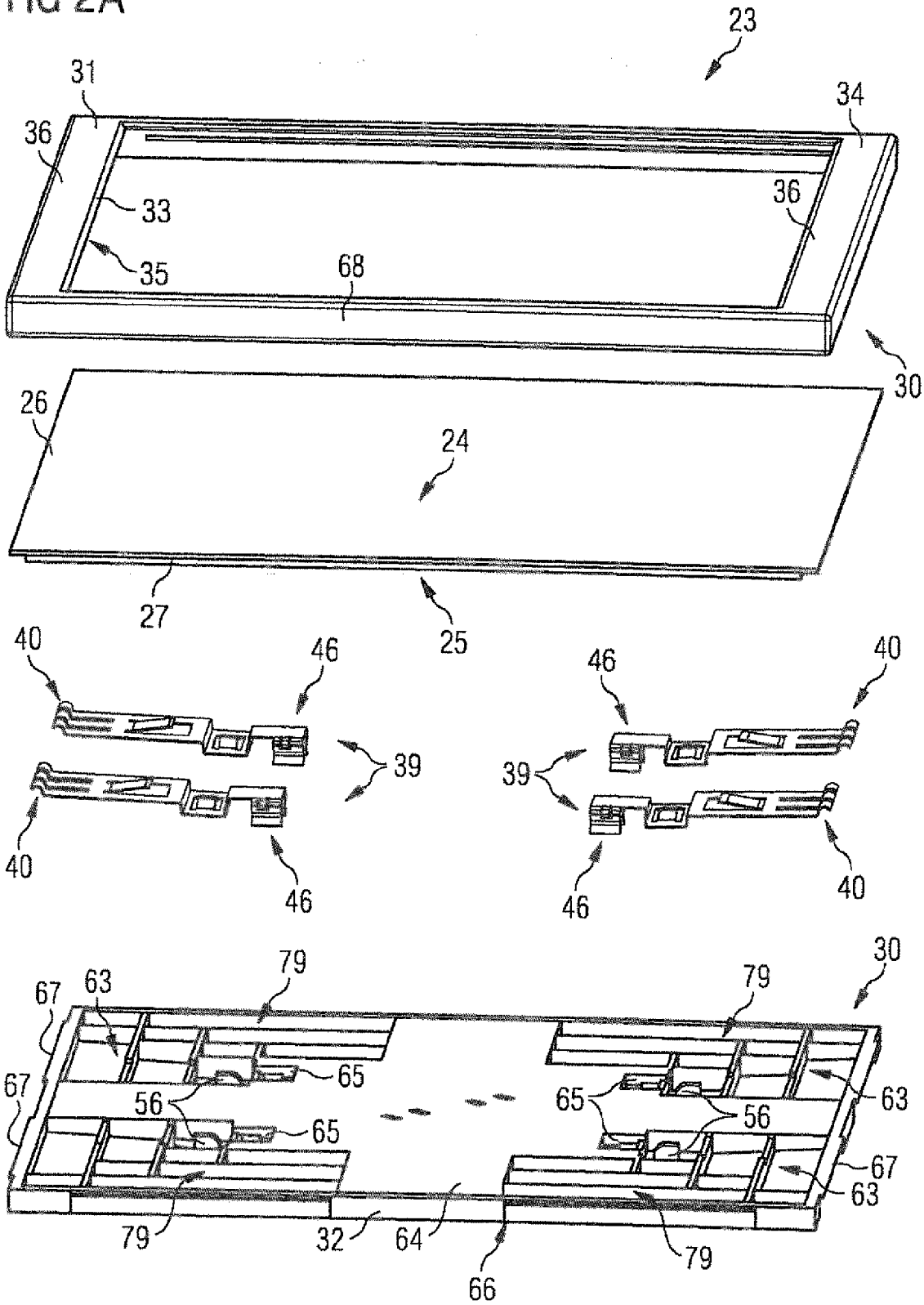
FIG. 2A shows an embodiment of an illuminant in a perspective exploded illustration.
Figure 2B:
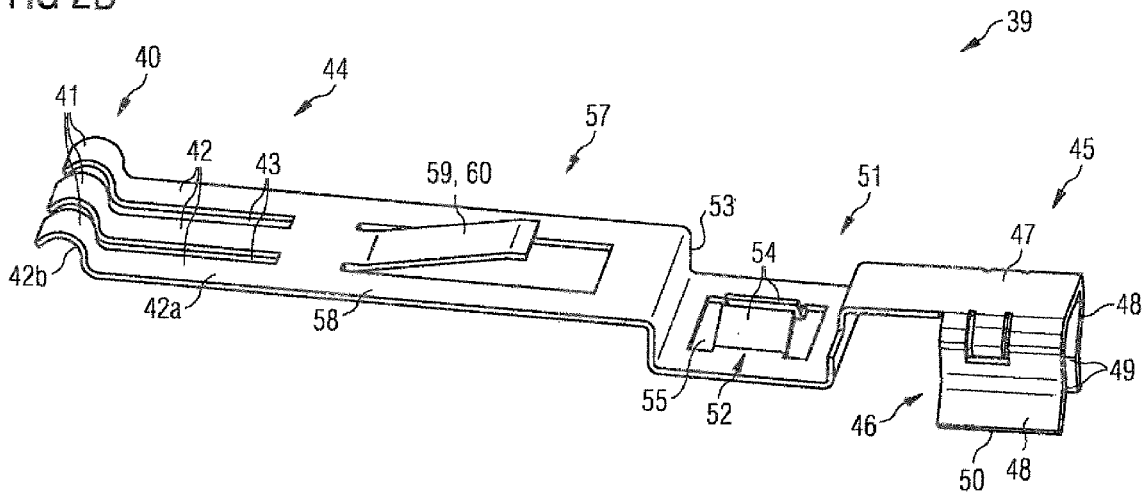
FIG. 2B shows a perspective illustration of an illuminant contact part of the illuminant according to FIG. 2A.
Figure 3:
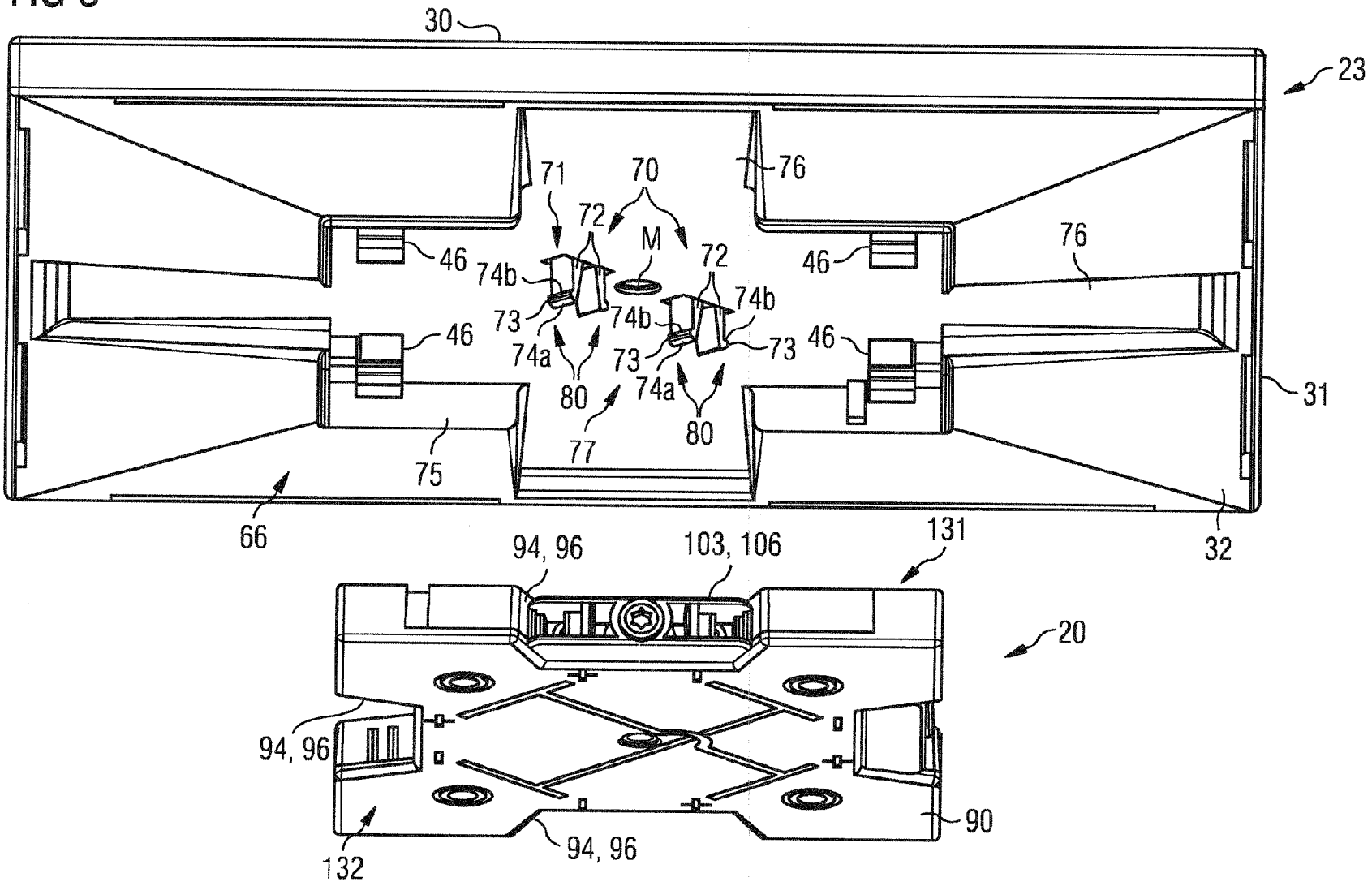
FIG. 3 shows a perspective illustration of the illuminant according to FIG. 2A as viewed from the rear side and also a perspective illustration of an embodiment of the lampholder.
Figure 5:
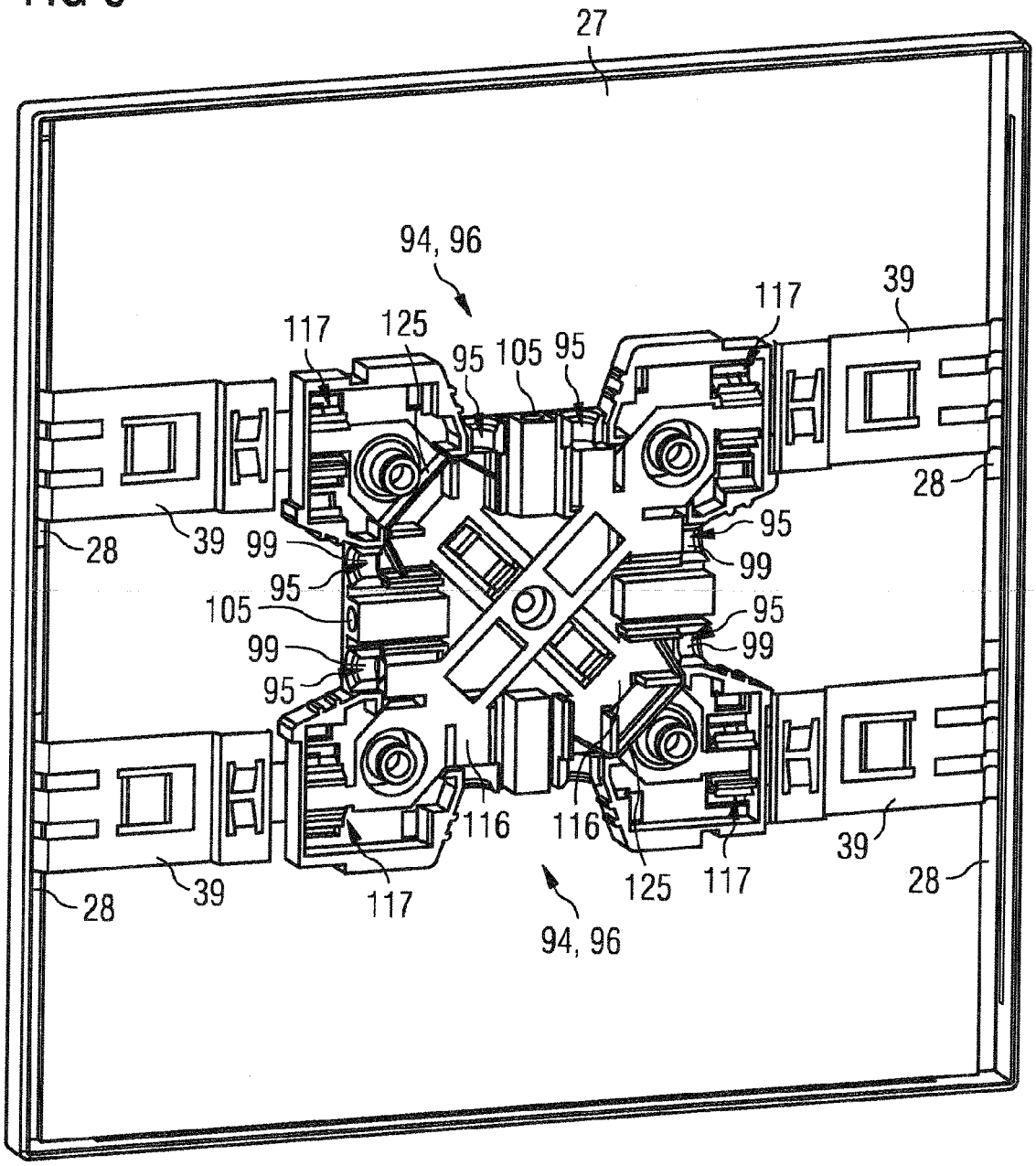
FIG. 5 shows the perspective illustration of the illuminant and of the lampholder according to FIG. 4, wherein the housing rear wall of the illuminant and also the mounting surface of the lampholder have been removed in order to illustrate the electrical connection.

FIGS. 2A and 2B show perspective exploded illustrations of an embodiment of the illuminant 23. The illuminant 23 includes a carrier element 25, which is plate-like or sheet-like. The carrier element 25 includes the semiconductor luminous element or is part of the semiconductor luminous element or is part of the semiconductor luminous element. In the embodiment, the carrier element 25 is structured in a sandwich-like manner in a number of layers. Here, the semiconductor luminous element is arranged between a front transparent plate or film 26 and a rear plate or film 27. In the embodiment, the plates 26, 27 are formed as glass plates. The front plate or film 26 is larger than the rear plate or film 27 and, in the embodiment, protrudes on two opposite sides beyond the rear plate or film 27. The front surface of the front plate or film 26 facing away from the semiconductor luminous element forms the luminous area 24 of the illuminant 23. Electrical contact surfaces 28 are arranged on the contact side of the front plate 26 facing away from the luminous area 24. One or more pairs of contact surfaces may be provided. In the embodiment, two pairs of contact surfaces 28 are provided on the two protrusions of the front plate 26. The semiconductor luminous element can therefore be contacted at different points in order to achieve a more uniform illumination, even if large luminous areas 24 are provided. One contact surface 28 of a pair is connected to the anode, and the other contact surface 28 of the same pair is connected to the cathode of the semiconductor luminous element. The contact surfaces 28 are illustrated in FIG. 5. In the embodiment, the contact surfaces 28 are arranged on two opposite sides of the semiconductor luminous element.

In the preferred embodiment, the luminous area 24 is designed as a planar area. In the case of the luminaire 15 illustrated in FIG. 1, the planar luminous areas 24 of the illuminant elements 23 are located in a common plane. Large total luminous areas on ceilings or walls can thus be composed in a modular manner from the individual luminous areas 24 of the illuminants 23.

The illuminant 23 further includes an illuminant housing 30, which consists of electrically insulating material. Here, the term "electrically insulating" is to be understood such that the DC voltages up to 200 V for example and direct currents up to 2 to 3 A for example normally applied across luminaires 15 are insulated. The illuminant housing 30 consists of a frame 31 and a housing rear wall 32, between which the carrier element 25 is mounted. The frame 31 includes a light exit opening 33, which has a rectangular contour in the embodiment. The light from the luminous area 24 is radiated through the light exit opening 33. The luminous area 24 thus constitutes the light radiation side of the carrier element 25. The illuminant housing preferably consists of plastic, for example polycarbonate. It may then be produced very easily and cost-effectively by injection molding. Polycarbonate is amorphous and has low warpage.

For example, the illuminant housing 30 has a square or rectangular contour. In various embodiments, it has a size of 150×150 millimeters. Side lengths corresponding to an integer factor of 600 millimeters are preferred, since ceilings in office or factory buildings often have a grid of 600×600 millimeters. For example, housing dimensions (length× width or width×length) of 300×300 millimeters, 150×300 millimeters, 200×150 millimeters, 100×100 millimeters, 100×200 millimeters, etc. are thus produced.

The thickness or depth of the illuminant housing 30 between the luminous area 24 and a rear side 66 of the housing rear wall 32 decreases outwardly from a central region toward all sides. Due to this tapering housing form, an advantageous aesthetic appearance is provided. The flatness of the illuminant housing 30 is emphasized. At the same time, there is sufficient space in the central region to receive the lampholder 20.

A web 34 running around annularly surrounds the light exit opening 33. On the side facing the luminous area 24, the web 34 has a bearing surface 35, against which the outer edge of the light radiation side of the carrier element 25 bears. The bearing surface 35 is formed as a planar surface. In a modification compared to the embodiment, the bearing surface 35 could also be provided only on the two web portions 36 provided on opposite sides of the light exit opening 33. In particular, the web portions 36 are provided at the point at which the contact surfaces 28 are arranged on the carrier element 25 or on the front plate 26 in order to simultaneously ensure sufficient contact protection. In all embodiments of the bearing surface 35, this surface is to be designed such that a desired alignment of the luminous area 24 with respect to the illuminant housing 30 is produced. This can be achieved in principle already by three interspaced bearing points.

Illuminant contact parts 39 for making electrical contact with the semiconductor luminous element are provided between the housing rear wall 32 and the carrier element 25. An enlarged illustration of the illuminant contact part 39 is illustrated in FIG. 2B. The illuminant contact part 39 is produced as a one-piece element and has no connection or seam points and consists of a uniform material. It is preferably formed as a punched and bent part and, in order to be produced, is punched out from a sheet metal and is then bent into the desired form.

The illuminant contact part 39 includes an illuminant contact 40, by means of which the illuminant contact part 39 bears against the associated contact surface 28 on the carrier element 25. The illuminant contact 40 may include a plurality of contact points 41, by means of which the illuminant contact 40 bears against the associated contact surface 28. In various embodiments, a plurality of contact tongues 42, and preferably three contact tongues, are provided, which are all identical. Each contact tongue 42 includes a level portion 42*a*, which is adjoined by the free end portion 42*b* including the contact point 41. The end portion 42*b* is bent away from the level portion 42*a* and has a curved course. The contact tongues 42 are movable with respect to one another and are separated from one another by slots 43. In the position of use, a spring effect of the contact tongues 42 is thus produced, such that the contact points 41 bear against the contact surface 28 with a certain spring prestress.

In various embodiments according to FIG. 2A, the illuminant 23 includes two contact surfaces 28 for each of the anode and cathode. Each contact surface 28 is associated with an illuminant contact part 39. The illuminant 23 accordingly has four illuminant contact parts 39.

The illuminant contact 40 forms the first end 44 of the illuminant contact part 39. At the opposite, second end 45, the illuminant contact part 39 includes an illuminant attachment point 46, which serves to provide an electrical connection to the lampholder 20. The illuminant attachment point 46 is formed as a detent/plug-in connection. It has two contact wings 48, which are interconnected via a crosspiece 47 and which are identical. The contact wings 48 protrude away transversely from the crosspiece 47, wherein they initially approach one another as far as a bend point 49 and move away from one another from the bend point to their respective free end 50. The two contact wings 48 have the shortest distance at the mutually opposed bend points 49. The contact wings 48 protrude away from the crosspiece in a direction against the bent-away ends 42*b* of the contact part 40. The crosspiece 47 lies in approximately the same plane as the level portion 42*a* of the contact tongues 42.

The first end 45 of the illuminant contact part 39 transitions into a holding portion 51, on which a holding clamp 52 is provided. By way of example, the holding portion 51 has a bend 53, within which the holding clamp 52 is located. The holding clamp is formed by two opposed clamping tongues 54, which are resiliently mounted on opposite sides of a holding cutout 25 on the holding portion 51. The two spring tongues 54 extend at an incline toward one another above the holding opening 55 in the bend 53, such that their free ends are arranged side by side in the bend 43. In the position of use, the illuminant contact part 39 is plugged onto a holding protrusion 56 on the housing rear wall 32, said holding protrusion engaging through the holding opening 55 and being clamped on both sides by the clamping tongues 54.

The illuminant contact part 39 includes a spring zone 57 between the holding portion 51 and the first end 44. The spring zone 57 includes a spring tongue 59 arranged resiliently on a tongue holding part 58 of the spring zone 57. This tongue is punched out in particular from the tongue holding part 58 and is bent away at the edge of the punched-out opening. The spring tongue 59 protrudes away from the tongue holding part 58 at an incline. In various embodiments, the tongue holding part 58 is located in a level extension of the level portion 42*a* of the contact tongues 42.

In the position of use, the spring tongue 59 of the spring zone 57 serves as a resilient bearing element 60. Between the housing rear wall 32 and the carrier element 25, one or more resilient bearing elements 60 are provided in order to press the carrier element 25 against the bearing surface 35 on the frame 31, such that the carrier element assumes the desired position. As illustrated in FIG. 2A, four bearing elements 60 are provided here. In the preferred embodiment, these are formed by the spring zone 57 and for example by the spring tongue 59. The spring tongue 59, in the position of use, bears against the carrier element 25 under spring prestress.

In the mounted state, the illuminant contact parts 39 each sit in a receiving region 63 on the side 64 of the housing rear wall 32 associated with the carrier element. Each receiving region 63 includes an illuminant attachment point opening 65 for the illuminant connection 60, said opening penetrating fully through the housing rear wall 32. The illuminant attachment point 46 or the contact wings 48 is/are thus accessible from the rear side 66 of the housing rear wall 32 opposite the inner face 64.

With the produced usage state of the illuminant 23, the frame 31 surrounds the housing rear wall 32 completely at the outer periphery thereof. Here, a detent connection is preferably produced between the frame 31 and the housing rear wall 32. In various embodiments, detent lugs 67 are provided for this purpose on the housing rear wall 32 on at least two opposed side edges and engage in indentations on the inner face on the frame cheek 68 running around annularly.

An illuminant connection device 70 is provided on the rear side 66 of the illuminant 23 or the illuminant housing 30 and serves to produce both the electrical and mechanical connection to the lampholder 20. At least two, and in accordance with the example four, illuminant attachment points 46 belong to the illuminant connection device 70. These illuminant attachment points 46 are each electrically conductively connected to an illuminant contact 40 via the illuminant contact part 39 and thus provide the electrical connection to the respective anode or cathode of the semiconductor luminous element.

Furthermore, detent means 71, which serve exclusively to produce or assist the mechanical connection between the illuminant 23 and the lampholder 20, belong to the illuminant connection device 70. The detent means 71 are formed in various embodiments by a plurality of detent protrusions 72. The detent protrusions 72 protrude away from the rear side 66 of the illuminant housing 30. At their free end, a detent bulge 73 is provided at the side. Once the detent connection has been established, the detent protrusions 72 engage through a detent cutout 74 on the lampholder, and the detent bulges 73 each engage behind an associated detent edge on the lampholder 20. In various embodiments, the detent protrusions 72 are arranged in pairs at a distance side by side. The detent bulges 73 each protrude away from the adjacent detent protrusion 72 in opposite directions.

The shape and/or the size of the detent protrusions 72 and in particular of the detent bulges 73 can be selected such that a sufficient retention of the detent connection is ensured on the one hand, and on the other hand the forces when establishing and/or separating the detent connection are not excessively great. For example, the inclination and/or the size of an inclined surface 74*a* of the detent bulge 73, said incline surface adjoining the free end of the detent protrusion 72, can be predetermined in order to set the desired plug-on force when establishing the detent connection. Similarly, the inclination and/or the size of a detent bearing surface 74*b*, by means of which the detent bulge 73 bears against the associated detent edge of the lampholder 20 when the detent connection is established, can be predetermined in order to set the desired removal force when separating the detent connection. The size and inclination of the surfaces 74*a*, 74*b* relates to the direction of extension of the detent bulge 73 transverse to the plug-on or removal direction of the illuminant 23. The plug-on and/or the removal force are adapted to the stability of the illuminant 23 so as to not damage this when it is plugged on and removed.

The illuminant connection device 70 is arranged in a cutout 75 in the housing rear wall 32. The illuminant attachment points 46 and the detent protrusions 72 are arranged symmetrically with respect to a center point M of the cutout 75 or the rear side 66. The detent protrusions 72 are arranged aligned along a radial straight line through the center point M on the housing rear wall 32. In various embodiments, the illuminant 23 may therefore be rotated by 180 degrees and connected in both rotated positions to the lampholder 20.

In a modified embodiment, a coding device may be provided. The illuminant connection device 70 includes a coding element 80, which cooperates with a coding mating element of the lampholder 20 and enables the connection between the illuminant 23 and lampholder to be established merely in the permissible relative positions. Electrically incorrect connections between the lampholder 20 and illuminant 23 can thus be prevented. A plurality of coding elements 80 may also be provided. Each coding element 80 is associated with a coding mating element of the lampholder 20. The coding element 80 and the associated complementary coding mating element may have any forms. The coding element 80, for example, may also be formed by a detent protrusion 72 or may be arranged on the detent protrusion 72. In various embodiments, the detent protrusions 72 serve as coding elements 80, which, on account of their position, merely allow the two above-described orientations of the illuminant 23 when establishing the connection to the lampholder 20. The coding device may alternatively also merely allow one or more than two possible relative positions between the illuminant 23 and the lampholder 20 when establishing the connection.

Figure 4:
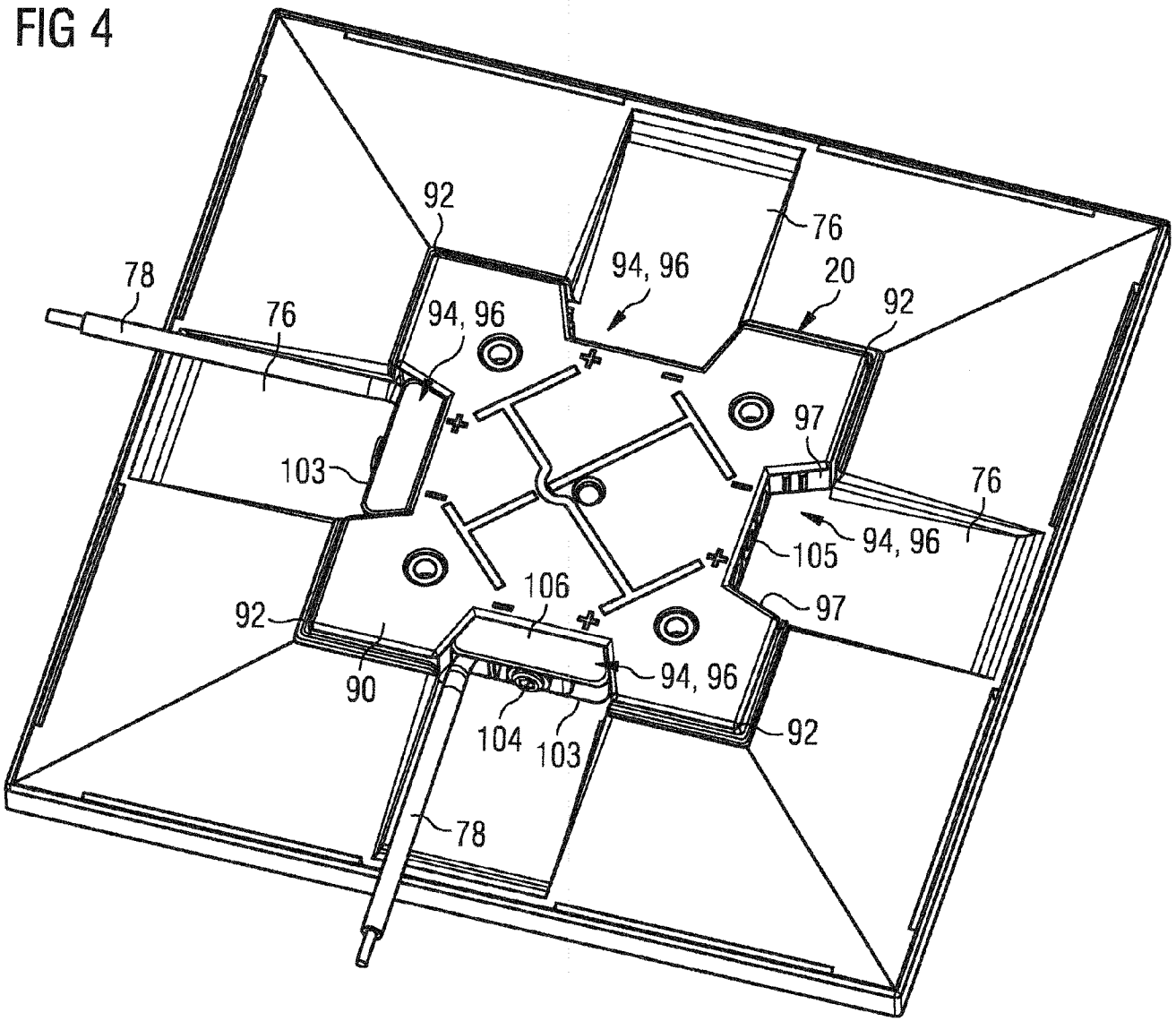
FIG. 4 shows the illuminant and the lampholder according to FIG. 3 with established connection.

The cutout 75 here has a rectangular and, for example, square contour. The cutout 75 is provided centrally in the housing rear wall 32. The cutout 75 continues on all four sides in a supply channel 76 in each case. The channels 76 and the cutout 75 have a common, preferably planar, base 77, which forms the rear side 66 of the housing rear wall 32 within the cutout 75 and the supply channels. Once a connection has been established between the lampholder 20 and the illuminant 23, the supply channels 76 serve to receive the cable 78, connected to the lampholder 20, of the supply line 16 (FIG. 4). In the region of the connection channels 76 and the cutout 75, the housing rear wall 72 is substantially level on its inner face. Besides this substantially level region, the housing rear wall 32 in its respective corner region includes an arrangement of stiffening ribs 79. The receiving region 63 for a respective illuminant contact part 39 is provided in a respective corner region having stiffening ribs 79. The stiffening ribs 79 include cutouts for receiving the illuminant contact part 39 in the receiving region 63.

The illuminant 23 in various embodiments consists of just a few individual parts: the illuminant housing 30, the carrier element 25 with one or more semiconductor luminous elements and in each case two illuminant contact parts 39 for each semiconductor luminous element provided. The illuminant contact parts 39 are identical. The illuminant 23 can thus be produced cost-effectively. A plurality of illuminants 23 can be easily grouped, wherein the luminous areas 24 can be aligned without difficulty in a plane. Luminaires 15 having a large total luminous area can thus be constructed. The illuminant 23 is also suitable, due to the encapsulation of the electrical connections in the illuminant housing 30, for higher DC voltages in the region of 200 V.

Figure 6:
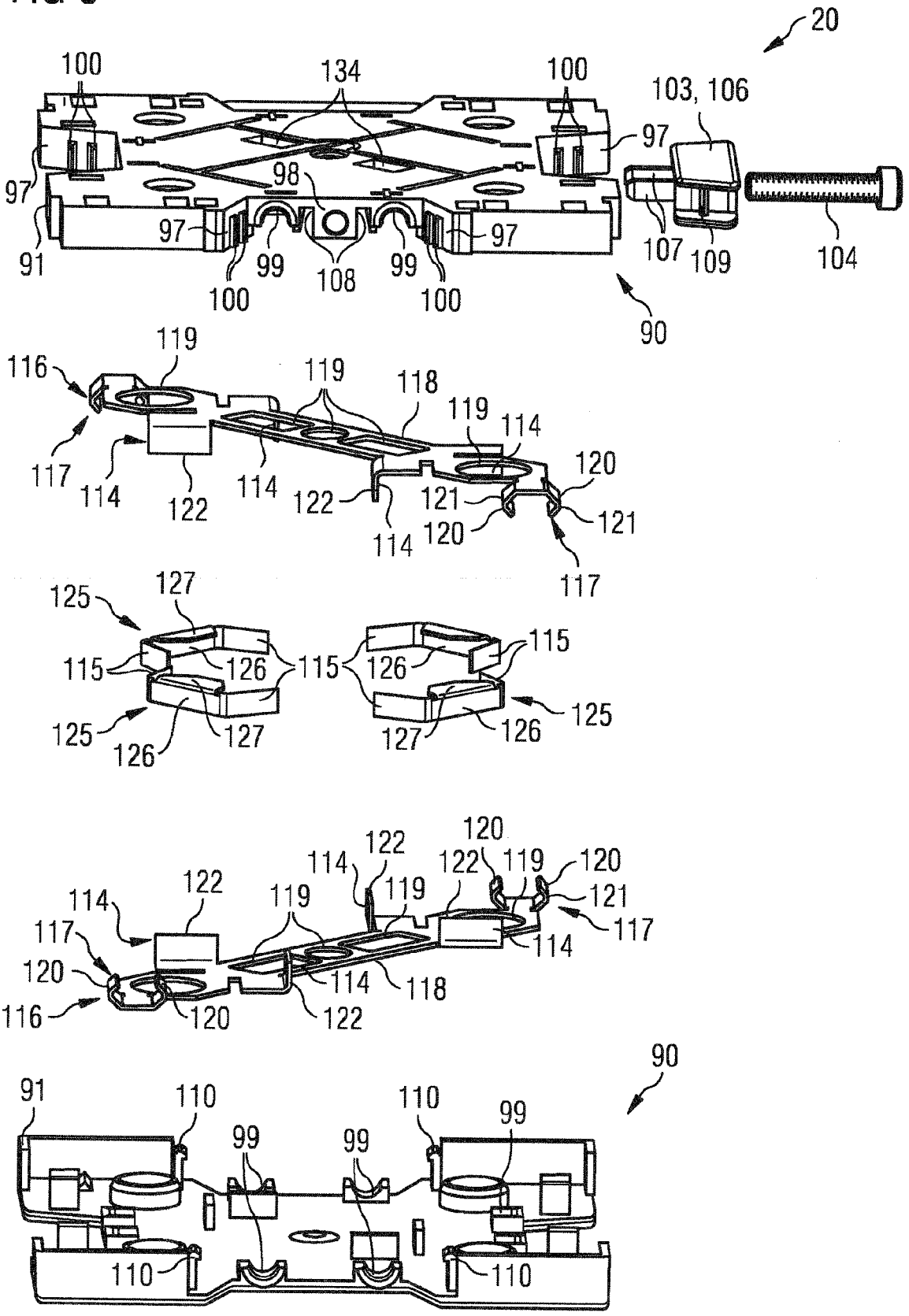
FIG. 6 shows a perspective exploded illustration of the lampholder according to FIGS. 3 to 5.
Figure 7:
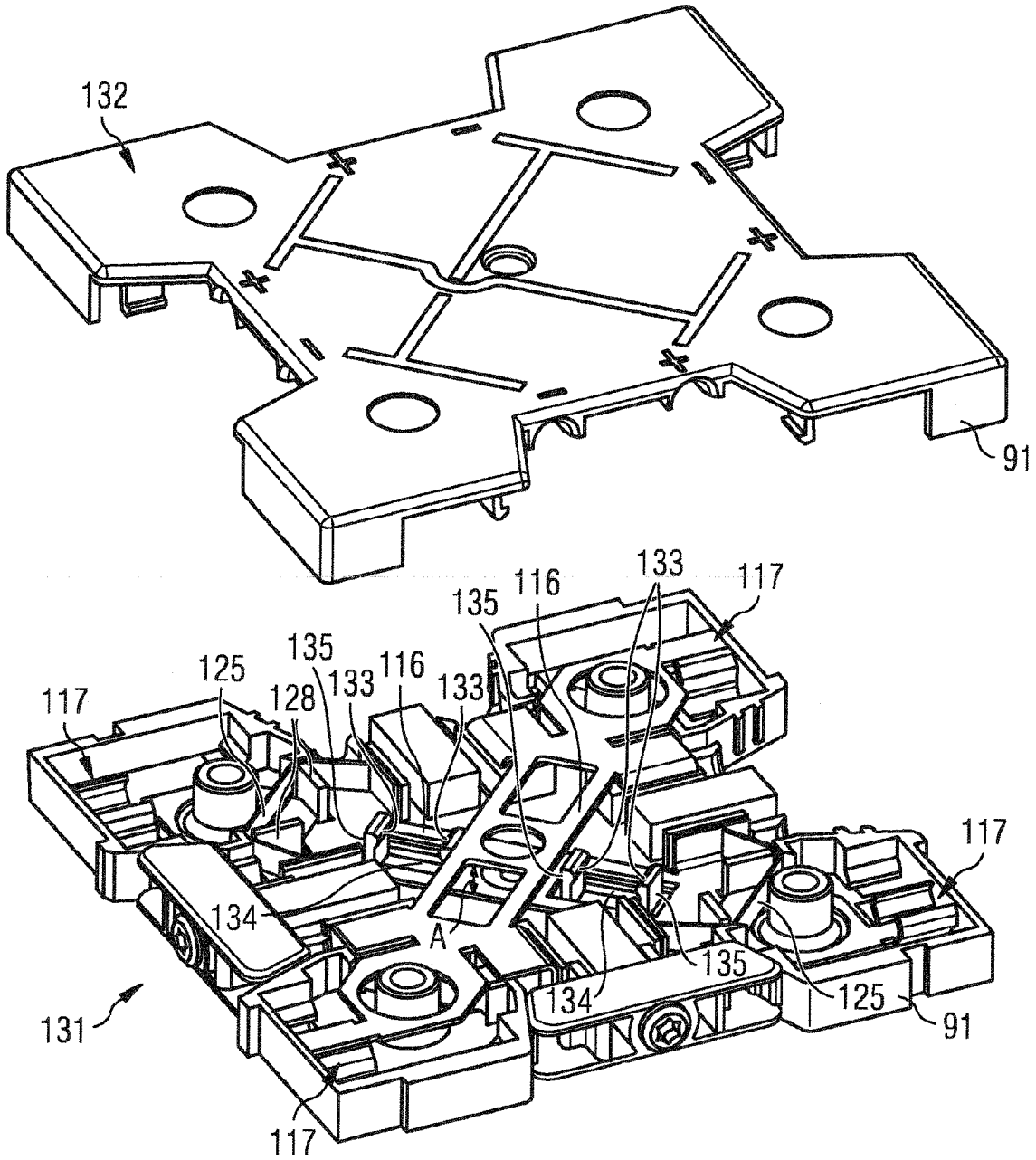
FIG. 7 shows the lampholder from FIG. 6 in a partly mounted state.
Figure 8:
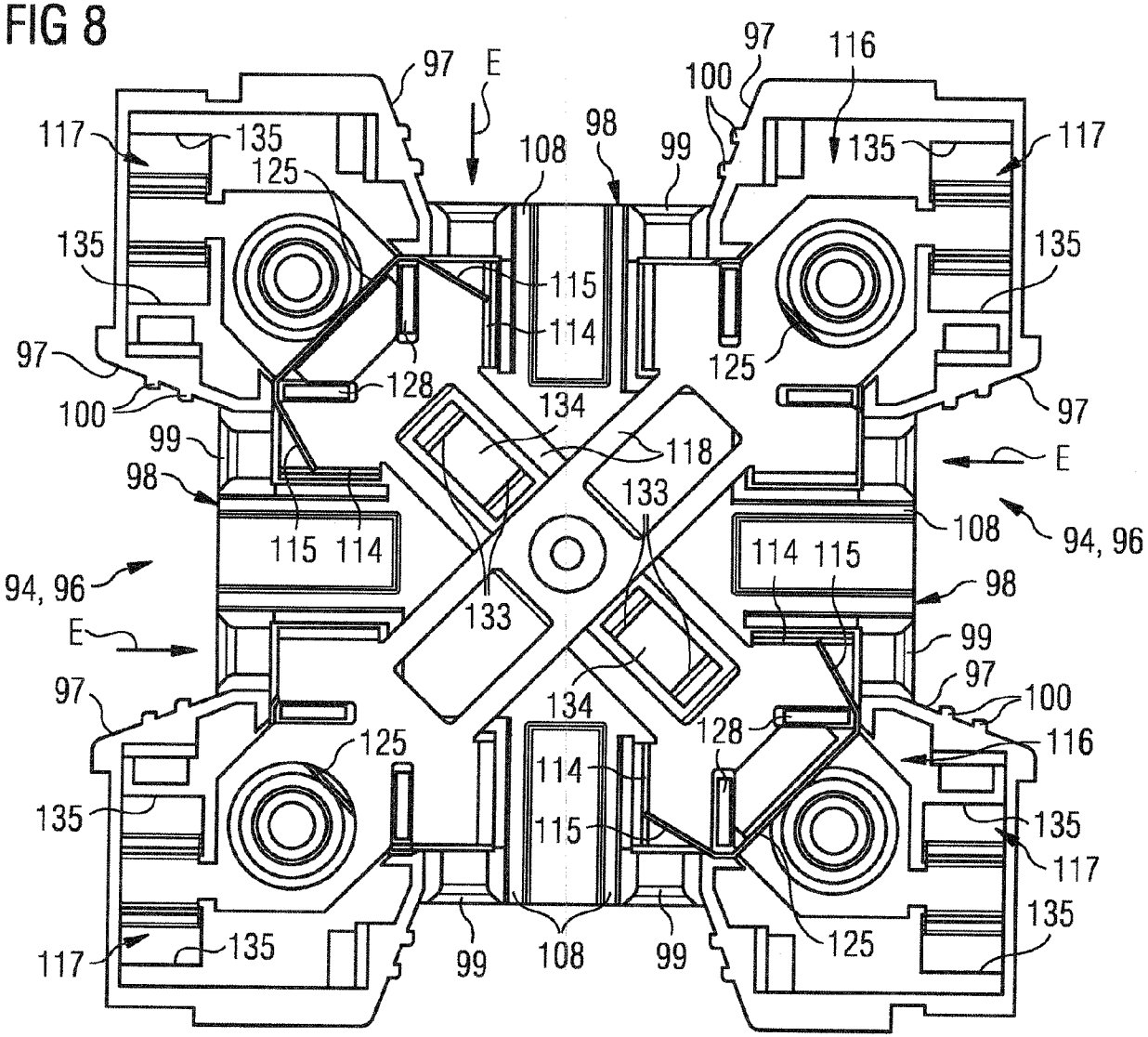
FIG. 8 shows a plan view of the opened lampholder housing as viewed from the assembly side.
Figure 9:
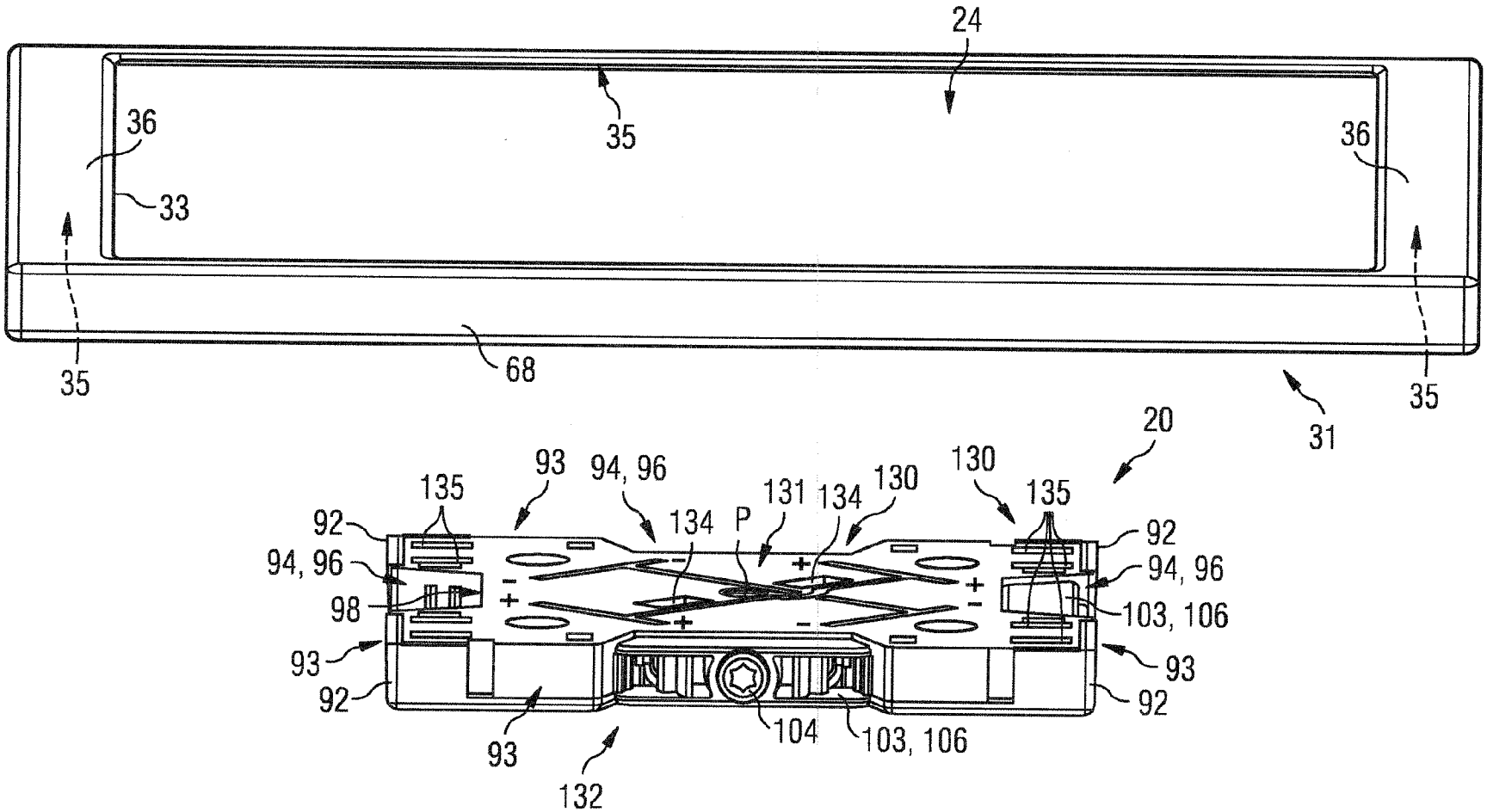
FIG. 9 shows a perspective view of the illuminant and the lampholder according to FIG. 3 as viewed from the front side of the illuminant and the connection side of the lampholder.
Figure 10:
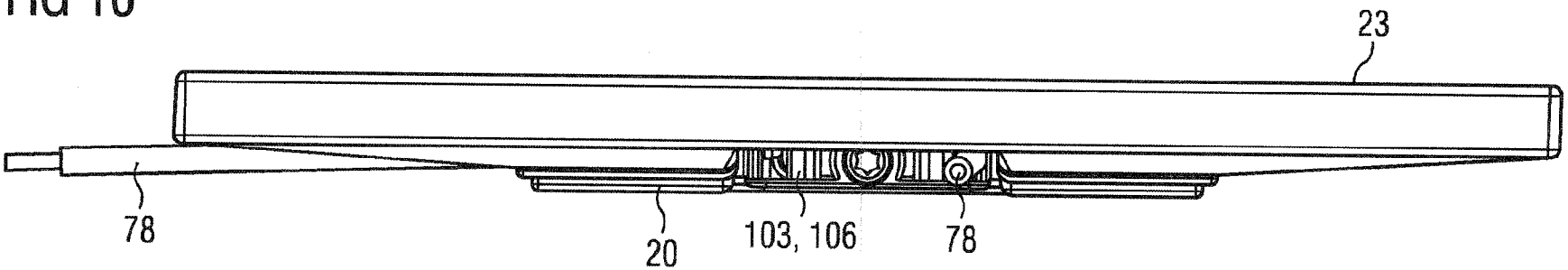
FIG. 10 shows a side view of the illuminant and the lampholder with established connection.

A lampholder 20 for use with/in the present disclosure is shown in FIG. 6 in an exploded illustration. The lampholder 20 includes a lampholder housing 90, which consists in various embodiments of two connectable housing shells 91. The lampholder housing 90 includes four right-angled corners 92, at which two adjacent lampholder housing sides 93 border one another. A connection region 94 with at least one electrical supply attachment point 95 is provided on at least one, preferably a plurality of, and in various embodiments on all, lampholder housing sides 93.

The supply attachment point region 94 is formed by an attachment point cutout 96 in the lampholder housing 90. The attachment point cutout is trapezoidal in plan view of the lampholder housing 90 and constitutes an incision in the respective lampholder housing side 93. Starting from the side portions adjoining the corners 92, the attachment point cutout 96 tapers inwardly by two opposed clamping sides 97. The clamping sides 97 are interconnected via a central side portion 98. An attachment point opening 99 is provided in this central side portion 98 for each supply attachment point 95. In various embodiments, one half of the attachment point opening 99 is provided on one of the two housing shells 91. One or more protruding clamping webs 100 are provided on the clamping sides 97 in various embodiments.

The lampholder 20 includes supply attachment points 95 of different polarity. Some of the supply attachment points 95 are associated with the negative pole and other are associated with the positive pole of the supply DC voltage. At least one supply attachment point associated with the positive pole and one supply attachment point 95 associated with the negative pole is provided on each lampholder housing side 93. In the embodiment of the lampholder 20 described here, a supply attachment point 95 associated with the positive pole and a supply attachment point 95 associated with the negative pole is provided in each supply attachment point region 94. Once the connection to the illuminant has been established, the supply attachment point region 94 is located at the point within the cutout 75 at which the supply channels 76 transition into the cutout 75. The maximum width of the attachment point cutout 96 corresponds here approximately to the width of the supply channel 76.

A strain relief means 103 is associated with each supply attachment point region 94 and can be fastened detachably to the lampholder housing 20, in accordance with the example with the aid of a central screw 104. An inner thread 105 is provided on the lampholder housing 90 and is open toward the central side portion 98. The strain relief means 103 is formed by a clamping element 106, which has a contour adapted to the attachment point cutout 96. In plan view, it therefore also has a trapezoidal contour. On its inner face associated with the central side portion 98, it includes two flat insertion tongues 107, which can be inserted into associated insertion slots 108 on the lampholder housing 90. The insertion slots 108 are in each case located between the inner thread 105 and an attachment point opening 99.

On its sides associated with the clamping sides 97, the clamping element 106 has a clamping edge 109, which, when the clamping element 106 is fastened to the lampholder housing 90, is arranged opposite the two clamping webs 100 of the associated clamping side 97 at a distance therefrom. A cable 78 present between the clamping edge 109 and the clamping webs 100 is clamped with a force fit and is thus relieved of strain. Due to the screw connection 104, 105, the strain relief can take up sufficient tensile forces on the cable 78. The number of clamping edges 109 and the number of clamping webs 100 for cable clamping may vary.

The mechanical connection between the two housing shells 91 can be produced by a detent connection, wherein a plurality of detent hooks 110 are provided for this purpose on one housing shell 91 and can be brought into a detent connection with detent mating means (not illustrated in greater detail) on the other housing shell 91 when the two housing shells 91 are plugged together.

The supply attachment points 95 are designed in the form of electric clamp connections. Each supply attachment point 95 has an electrically conductive attachment point surface 114. Each attachment point surface 114 is associated with a resilient attachment point clamp 115, of which the free end in the rest position bears against the attachment point surface 114 or at least is arranged opposite said attachment point surface at a short distance. The attachment point surface 114 is arranged parallel to a direction of insertion E beside the insertion opening 99. On the opposite side of the insertion opening 99, the attachment point clamp 115 is pivotably hinged in a resilient manner. In the starting position, the attachment point clamp 115 thus runs behind the associated attachment point opening 99 at an incline with respect to the attachment point surface 114. When a core end of a cable 78 is inserted, the attachment point clamp 115 is pivoted away from the associated attachment point surface 114 by the core end inserted in the direction of insertion E and presses the uninsulated core end resiliently against the attachment point surface 114, such that reliable electrical contact is established between the core of the cable 78 and the attachment point surface 114. When mounting a luminaire 15, a very simple wiring of the lampholders can thus be implemented. Since the lampholder 20 includes supply attachment points 95 on a plurality of and, by way of example, all lampholder housing sides 93, the supply line 16 can be attached from all sides to the lampholder 20.

In the lampholder housing 90, all supply attachment points 95 of the same plurality are short-circuited to one another and are thus at the same potential. A plurality of lampholders 20 or the associated illuminants 23 can thus be connected in series or parallel very easily, because the lampholder housing 90 can be selectively electrically connected at one of the supply attachment points 95 to a supply attachment point 95 of another lampholder housing 90. In the embodiment of the luminaire 15 illustrated in FIG. 1, the lampholders 20 are interconnected in series (supply line 16 with solid and dashed lines). The supply line is guided from the positive pole of the voltage source 17 in series through all lampholders 20 and, starting from the last lampholder 20, is preferably guided back over a direct path to the negative pole of the voltage source 17. A parallel connection of the lampholders 20 would just as easily be possible, and is indicated alternatively in FIG. 1 by the dotted supply line 16. Since the lampholders 20 include supply attachment points 95 from all sides, the wiring effort with a luminaire 15 having a plurality of lampholders 20 is very low.

The lampholders 20 may also be attached in groups to an associated voltage source 17 or current source 17' and are preferably connected to one another in series or also in parallel.

The short circuit of the supply attachment points 95 of identical polarity is achieved in that the attachment point surfaces 114 of the supply attachment points 95 of identical polarity are provided on a common short-circuit connector 116. The short-circuit connector 116 is designed as an electrically conductive component. In various embodiments, it is produced in one piece without connection and join points from a uniform material and in particular is designed as a punched and bent part. The short-circuit connector 116 can be punched out, for example, from an electrically conductive sheet metal and bent into the desired form and can thus be produced cost-effectively and easily. All short-circuit connectors 116 are identical. For the lampholder 20, only one single type and one single form of the short-circuit connector 116 therefore has to be produced.

The short-circuit connector 116 additionally includes one or more lampholder connections 117, which serve to establish an electrical connection to an associated illuminant 23. In various embodiments, two lampholder connections 117 are provided on each short-circuit connector 116 and are consequently electrically short-circuited via the short-circuit connector 116. As a result, not only are the supply attachment points 95 of identical polarity electrically short-circuited, but also the lampholder connections 117 of identical polarity, for example via a common short-circuit connector 116. In various embodiments, the lampholder 20 serves to attach an illuminant to two semiconductor luminous elements, which each include an anode connection and a cathode connection. Two lampholder connections 117 of positive polarity and two lampholder connections 117 of negative polarity are therefore provided. The number of the pairs of lampholder connections 117 of different polarity may therefore be dependent on the number of semiconductor luminous elements provided in the illuminant 23.

Each short-circuit connector 116 includes a base portion 118 extending substantially in a plane. A plurality of apertures 119 may be provided in this base portion 118. Different positioning or connection means, which are provided in the lampholder housing 90, can pass through the apertures 119, as is illustrated for example in FIG. 7.

A lampholder connection 117 is provided at each of the two opposite ends of the base portion 118. The lampholder connection 117 includes two opposed connection tongues 120 extending transversely away from the base portion 118. Starting from the base portion 118, the two connection tongues 120 first run away from one another as far as a deflection point 121, and from the deflection point run toward one another again as far as their respective free end, wherein the free ends are distanced from one another. The two connection tongues 121 are identical. The lampholder connection is symmetrical with respect to a center plane. The respective center planes run through the lampholder connections 117 of a short-circuit connector 116 parallel to one another at a distance. With respect to a longitudinal center axis through the base portion 118, the center planes of the lampholder connections 117 are bent by approximately 45 degrees.

The attachment point surfaces 114 provided on the short-circuit connector 116 are provided on substantially planar connection parts 122. The attachment point surfaces 114 are inclined with respect to the longitudinal center axis through the base portion 118 by approximately 45 degrees. They run either parallel to the center planes of the lampholder connections 117 or at right angles thereto. The connection parts 122 with the connection faces 114 protrude away from the base portion 118 substantially at right angles. The free ends of the connection tongues 120 and the free end edges of the connection parts 122 are arranged at a distance from the base portion 118 on the same side and may preferably lie for example in a plane. Apart from the lampholder connections 117, the short-circuit connector 116 is formed symmetrically with respect to its longitudinal center plane.

Each attachment point surface 114 of a short-circuit connector 116 is associated with a different supply attachment point region 94. One of the short-circuit connectors 114 contains the attachment point surfaces 114 of the supply attachment points 95 of positive polarity, whereas the other short-circuit connector 116 include the attachment point surfaces 114 of the supply attachment points 95 of negative polarity.

The supply attachment points 95 of identical polarity of directly adjacent supply attachment point regions 94 are arranged side by side as viewed in the peripheral direction around the lampholder housing 90, that is to say, starting from a corner 92, a supply attachment point 95 having the same polarity follows both lampholder housing sides 93. These two supply attachment points 95 are associated with a common clamping element 125, of which the end portions each form an attachment point clamp 115 for different supply attachment points 95. The two attachment point clamps 115 are interconnected via a central piece 126. The attachment point clamps 115 protrude transversely away from the central piece 126, wherein their spacing increases. For example, an angle in the range from 100 to 110 degrees is enclosed between the central piece 126 and the attachment point clamp 115. The transition between the attachment point clamp 115 and the central piece 126 is bent twice in various embodiments. A support part 127 is bent at right angles on a longitudinal edge of the central piece 126 and rests, during use, on the base area of one of the two housing halves 91. In the transition region between the central piece 126 and the clamping element 115, the attachment point clamping element 125 is supported in each case on a support protrusion 128 of the lampholder housing 90. The support protrusion 128 is arranged opposite the attachment point surface 114 beside the attachment point opening 99 in one of the two housing halves 91. The support part 127 is arranged between the two support protrusions 128.

For the four supply attachment points 95 of positive polarity and the four supply attachment points of negative polarity, two attachment point clamping elements 125 are provided in each case by way of example, and a total of four attachment point clamping elements 125 are provided. The four attachment point clamping elements 125 are identical.

During use, the two short-circuit connectors 116 in the lampholder housing 90 intersect, wherein they run at the point of intersection with an insulation distance A from one another. No insulating materials are provided at the point of intersection between the two short-circuit connectors 116. The region between the two short-circuit connectors 116 at the point of intersection is designed as a free space. In order to achieve the insulation distance A at the point of intersection, one of the two short-circuit elements 116 is arranged on its back in the lampholder housing 90 and, for example, rotated by 90 degrees with respect to the other short-circuit element 116. The free ends of the connection parts 122 and/or of the connection tongues 120 of one short-circuit element 116 preferably lie in a plane in which the base portion 118 of the other short-circuit element 116 lies. The distance between the plane in which the free ends of the connection parts 122 and/or the connection tongues 120 of one short-circuit element 116 lie and the base portion 118 of the other short-circuit element 116 is at least smaller than the distance between the two short-circuit elements 116. The base portion 118 of one short-circuit connector bears against the inner face of a housing half 91, whereas the base portion 118 of the other short-circuit connector 116 bears against the inner face of the other housing shell 91. In other words, the base portions 118 of the two short-circuit connectors 116 are located in substantially parallel planes in the lampholder housing 90, arranged at an insulation distance A.

The lampholder 20 includes a lampholder attachment device 130, which serves to mechanically and electrically connect the lampholder 20 to an associated illuminant 23. The lampholder connections 117, which are provided in accordance with the example on the short-circuit connectors 116, belong to the lampholder attachment device 130. The lampholder attachment device 130 further includes mechanical connection means, which ensure the mechanical connection to the illuminant 23, either alone or together with the lampholder connections 117. The lampholder attachment device 130 is provided on a connection side 131 of the lampholder housing 90 and is accessible from this connection side 131. The mounting side 132 opposite the connection side 131 serves to fasten the lampholder housing to a fastening surface, for example the wall or the ceiling of a room, or to another surface.

The mechanical connection means of the lampholder attachment device 130 are formed in the embodiment described here by detent edges 133, which are arranged in the lampholder housing 90 following a lampholder housing opening 134. Resiliently mounted holding elements 135, which are resiliently pivotably hinged adjacently to the lampholder housing 134, are integrally formed on two opposite sides of the lampholder housing opening 134. At their respective free end, they carry the detent edge 133 protruding toward the opposed holding element 135. Detent protrusions 72 having detent bulges 73 can engage through the lampholder housing opening 134 into the lampholder housing 90 and can engage around the detent edges 133 in order to produce the mechanical connection between the lampholder 20 and illuminant 23.

Lampholder attachment point openings 135 are also provided on the connection side 131 of the lampholder housing 90, the lampholder connections 117 being accessible via said lampholder attachment point openings. In various embodiments, two lampholder attachment point openings 135 are associated with each lampholder connection 117, such that both connection tongues 120 of a lampholder connection 117 are accessible via a lampholder attachment point opening 135. The lampholder attachment point openings 135 are slot-shaped for reasons of contact protection, such that the lampholder connection 117 cannot be contacted by a finger.

The electrical contact between the illuminant 23 and the lampholder 20 is preferably established in that the illuminant attachment points 46 bear against the lampholder connections 117. In the embodiments described here, the illuminant attachment points 46 engage around the lampholder connections 117. Here, the two connection tongues 120 of a lampholder connection 117 are arranged between the two contact wings 48 of the associated illuminant attachment point 46. A contact tab 48 bears against a connection tongue 120. Due to the resilient mounting of the contact tabs 48 and also of the connection tongues 120, a mechanical clamping force is also produced when establishing the electrical connection between the illuminant 23 and lampholder 20. Should this mechanical clamping force be sufficient, it is possible to dispense with further mechanical connection means between the illuminant 23 and lampholder 20.

The lampholder attachment device 130 is provided symmetrically with respect to a center point P on the connection side 131. The two lampholder housing openings 134 are provided on a radial straight line through the center point P at equal distance from the center point P in the connection side 131 of the lampholder housing 20. The lampholder housing 20 can be rotated here by 180 degrees about an axis of rotation through the center point P and can be connected in these two rotated positions to the illuminant 23.

An illuminant 23 and a lampholder 20 for a luminaire 15 have been described. The features of the lampholder 20 may also be produced independently of the features of the illuminant 23. The illuminant 23 includes a preferably planar luminous area 24. One or more semiconductor luminous elements are arranged in an illuminant housing 30. The illuminant connection device necessary for mechanical and electrical connection to the lampholder 20 is provided on the rear side 66 of the illuminant 23 opposite the luminous area 24. The dimensions of the illuminant 23 are preferably greater than those of the lampholder 20, such that the illuminant 23 completely covers the lampholder 20 when viewed from the luminous area 24. A particularly aesthetic impression can thus be achieved. The lampholder, on a plurality of lampholder housing sides 93, includes a supply attachment point region, such that the electric supply and wiring of the lampholder 20 can be implemented selectively from different sides or also simultaneously form a number of sides. Irrespective of the number and the arrangement of the supply attachment point regions 94, a plurality of electric supply attachment points 95 of identical polarity are provided on the lampholder 20. These supply attachment points 95 of identical polarity are electrically short-circuited. A short-circuit connector 116 is used in each case to short circuit the supply attachment points of identical polarity, wherein two identical short-circuit connectors 116 in particular are arranged in the lampholder housing 90. A DC voltage is applied across the lampholder 20 and may be up to 200 V for example. Large total luminous areas of a luminaire 15 with a cumulative aesthetic appearance can be achieved very easily in a modular manner with this lampholder 20 and the illuminant 23.

A holding body according to an embodiment of the disclosure will be described in detail hereinafter with reference to FIGS. 11A and 11B. A plurality of such holding bodies can be put together so as to form a holding structure or a holding frame according to the disclosure. One or more such holding bodies can be used, for example, together with a plurality of the above-described lampholders and illuminants. However, the holding bodies shown may also be used with differently formed lampholders or illuminant. In this regard, a lampholder 20 is depicted by way of example in FIG. 13 in a simplified and schematic illustration and can be used with the holding body 1 according to FIGS. 11A and 11B or can be mounted thereon. FIG. 14—likewise in a simplified, schematic illustration—shows a surface-light lamp 23, which can be used together with the holding body 1 according to FIGS. 11A and 11B and the lampholder according to FIG. 13 in order to form a luminaire.

As is shown in FIGS. 11A and 11B, the holding body 1 is formed as a flat plate body. Here, the plate body has the form of a strip or band, in particular in the form of a rectangular strip. In other words, the holding body 1 is elongate and flat, that is to say the extension in the longitudinal direction L is greatest and the extension in the direction of thickness t is lowest. The holding body 1 may be produced, for example, from metal or a suitable plastic material. The holding body 1 is formed rigidly in particular.

The lower plate side 1*b* is planar, that is to say is level (see FIG. 11B).

By contrast, the upper plate side 1*a* has a middle, raised surface portion 3, which is arranged centrically/centrally in the longitudinal direction of the plate. The raised surface portion 3 is level and, in plan view, has a rectangular shape. A through-hole 13 is formed centrally in the raised surface portion 3 and serves to receive a fastening element, such that the plate body 1 can be fastened to a fastening surface (for example a wall or a ceiling).

The upper plate side 1*a*, at the longitudinal ends, further includes two lowered edge regions, which, in the longitudinal direction L, each directly adjoin the middle surface portion 3. In other words, two steps are formed in the upper plate side 1*a*. For this purpose, a cutout is formed on the plate upper side 1*a* at each of the two plate longitudinal ends. In accordance with this embodiment, the cutout is square in plan view. Connection tabs or connection tongues, which protrude at the end face from the raised surface portion 3, are formed by the cutouts. The respective cutout has a level base 5*a* or 5*b*. A level vertical surface portion, from which the step is formed, is formed between the respective base 5*a*, 5*b* and the raised surface portion 3. The raised surface portion 3 and the base 5*a*, 5*b* of the respective cutout are each formed as level horizontal surfaces.

In the region of the raised surface portion 3, the plate body has a thickness $t_2$, and in the region of the cutouts the plate body has a thickness $t_1$, wherein the thickness $t_2$ is approximately twice as large as the thickness $t_1$. In other words, the cutout extends in the depth direction/thickness direction (t-axis in FIG. 11A) of the plate approximately as far as the center of the plate. In the width direction (B-axis in FIG. 11A), the respective cutout extends beyond the entire width of the plate. In the longitudinal direction (L-axis in FIG. 11A), the respective cutout extends by a certain amount toward the center of the plate, starting from the respective plate longitudinal end. The two cutouts/tabs are identical.

A through-hole 9*a*, 9*b*, which serves to receive a fastening element, by means of which two adjacent holding bodies 1 can be connected, is formed in the base 5, 5*b* of the respective cutout. The respective through-hole 9*a*, 9*b* may include an inner thread. In accordance with the shown embodiment, at least one of the through-holes includes an inner thread, here the through-hole 9*b*. For example, both through-holes 9*a*, 9*b* include an inner thread. The respective through-hole 9*a*, 9*b* is arranged here centrally in the base 5*a*, 5*b* of the respective cutout. As can be seen from FIG. 11B, the through-hole 9*a* leads on the plate underside 1*b* into a countersink 10.

Furthermore, a plurality of holes 11*a*, 11*b* for receiving a fastening means or for fastening a lampholder 20 are shaped/formed on the plate underside 1*b* at each of the two longitudinal ends. The holes 11*a*, 11*b* may be formed as blind holes or through-holes. In the shown embodiment, the holes 11*a*, 11*b* are formed as through-holes, which lead into the base 5, 5*b* of the respective cutout. In the shown embodiment, the holes 11*a*, 11*b* each have an inner thread. In accordance with the shown embodiment, four through-holes 11*a*, 11*b* per cutout are provided. The through-holes 11*a*, 11*b* are arranged here uniformly about the respective centrally arranged through-hole 9*a*, 9*b* (here in an outer edge region of the cutout).

The cutout or tab 5*a*, together with the through-hole 9*a* on the plate upper side 1*a*, forms a first holding body connection portion 7*a*, which is arranged on a first longitudinal end (to the left in FIG. 11A) of the holding body 1. Similarly, the cutout or tab 5*b*, together with the through-hole 9*b* on the plate upper side 1*a*, forms a second holding body connection portion 7*b*, which is arranged on the second longitudinal end (to the right in FIG. 11A) of the holding body 1. That is to say, a holding body connection portion in the form of the cutout and the central through-hole is formed on the respective longitudinal end of the plate body 1. Here, an engagement portion is formed by the cutout and can be brought in a form-fitting manner into engagement with the engagement portion of another, identical holding body (for example, see FIGS. 15A and 15B), wherein the two central through-holes 9*a*, 9*b* in the adjacent holding bodies are then aligned with one another.

The four further through-holes 11*a*, 11*b* arranged around the centrally arranged through-hole 9*a*, 9*b* form, on the plate underside 1*b*, a respective lampholder fastening portion 8*a*, 8*b*, to which a lampholder 20 can be fastened (see FIG. 11B).

Figure 13:
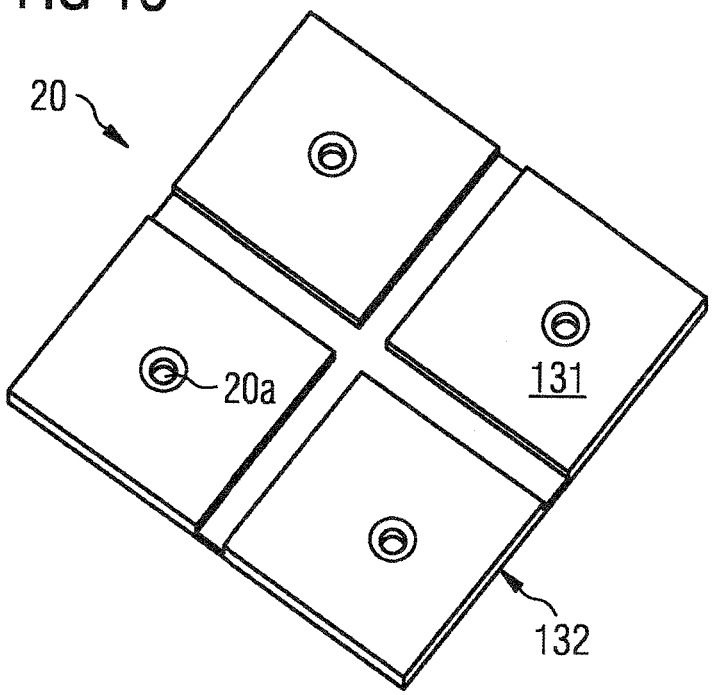
FIG. 13 shows a plan view of a lampholder for use with the holding body according to FIGS. 11A and 11B.
Figure 14:
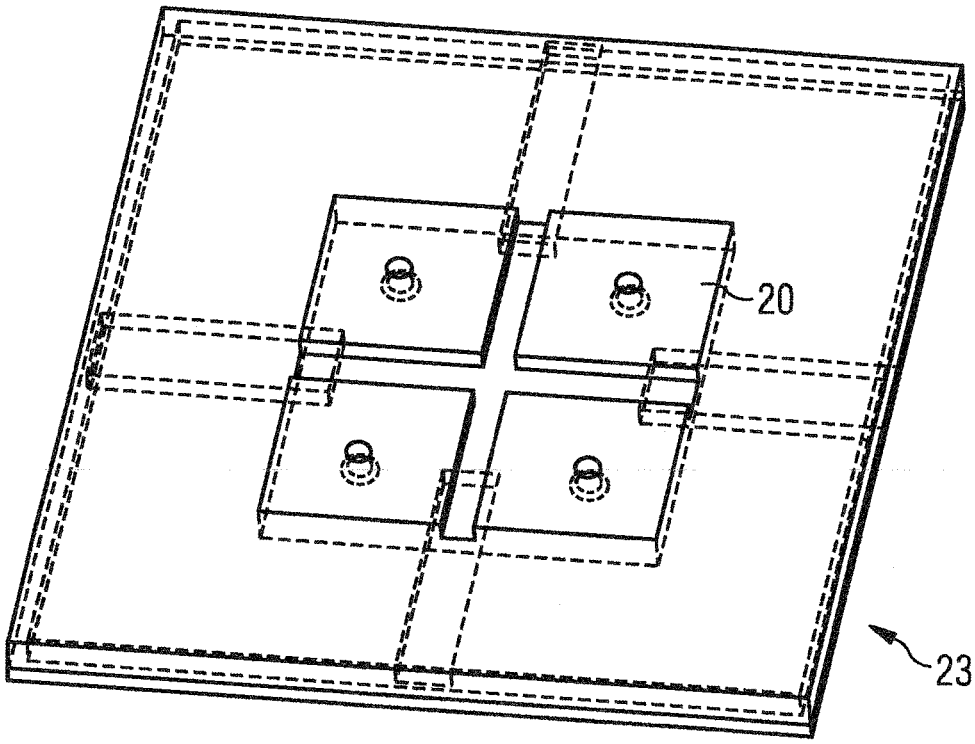
FIG. 14 shows the underside of a surface-light lamp, on the housing rear side of which a cutout is formed, in which a lampholder according to FIG. 13 is at least partially received so as to contact the lamp holder with the lamp.

As shown in FIG. 13, four through-holes 20*a* are formed in the lampholder 20 (corresponding to the number of holes per lampholder fastening portion 8*a*, 8*b*) and extend between the upper flat side 131 and the lower flat side 132 of the flat lampholder 20. The lampholder 20 can be placed via its lower flat side 132 onto the level plate underside 1*b*, such that the through-holes 20*a* and the lampholder 20 are aligned with the through-holes 11*a* or 11*b* of an associated lampholder fastening portion 8*a*, 8*b*. Fastening means, here screws, can then be introduced into the through-holes 20*a* in the lampholder 20 and fastened into the through-holes 11*a*, 11*b* in the plate, for example screwed in. A total of two lampholders 20 can thus be fastened to the holding body 1 on the plate underside 1*b* thereof at a defined/predetermined distance from one another. As indicated in FIG. 14, a surface-light lamp 23 can be plugged onto the respective lampholder 20, for which purpose a corresponding cutout for receiving the lampholder 20 can be formed on the rear side of the surface-light lamp 23.

It is noted that the number and respective position of the through-holes 9*a*, 9*b*, 11*a*, 11*b* is variable and is not restricted to the shown/described number or respective position.

The connection between two holding bodies 1, 1' to form a linear or right-angled holding structure will be explained hereinafter with reference to FIGS. 15A and 15B and also FIGS. 16A and 16B. The holding bodies 1 and 1' are completely identical here and are formed as shown in each of the FIGS. 11A and 11B. The reference signs of one holding body have been provided with a "" merely for improved understanding.

Figure 12:
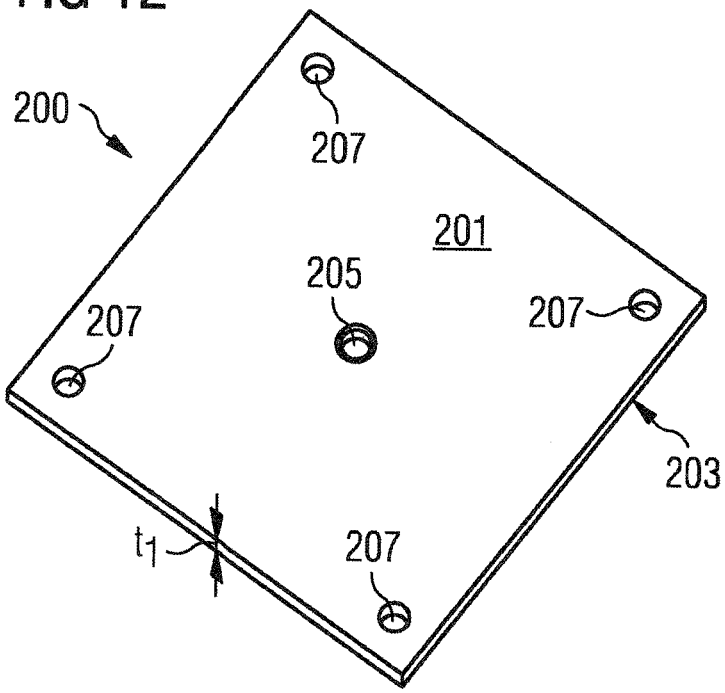
FIG. 12 shows a plan view of a termination piece for use with the holding body according to FIGS. 11A and 11B.
Figure 15A:
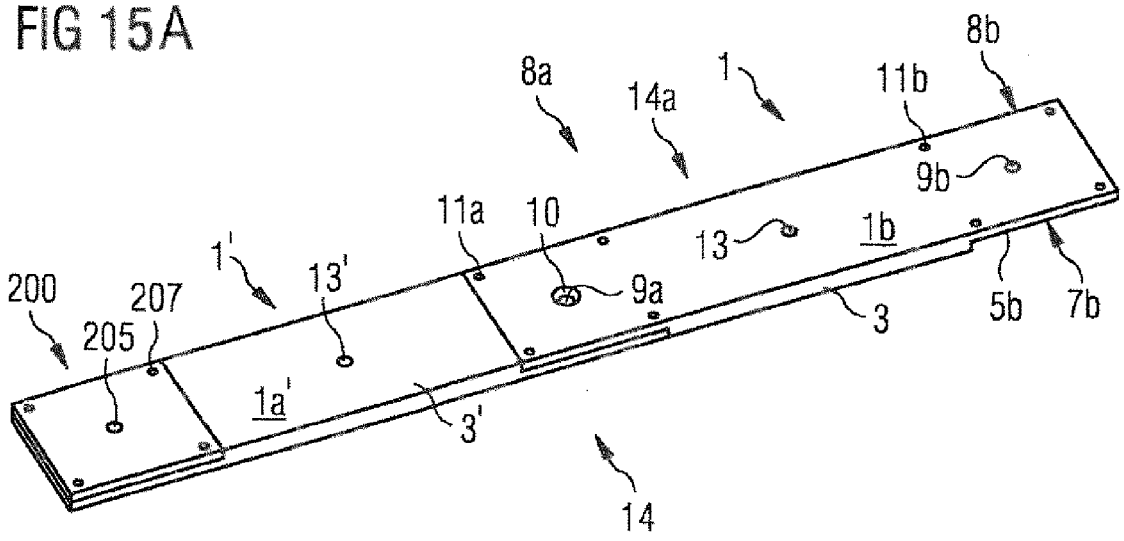
FIGS. 15A and 15B show a plan view and view from below respectively of a holding structure, which is formed from two holding bodies according to FIGS. 11A and 11B and also a termination piece according to FIG. 12.
Figure 15B:
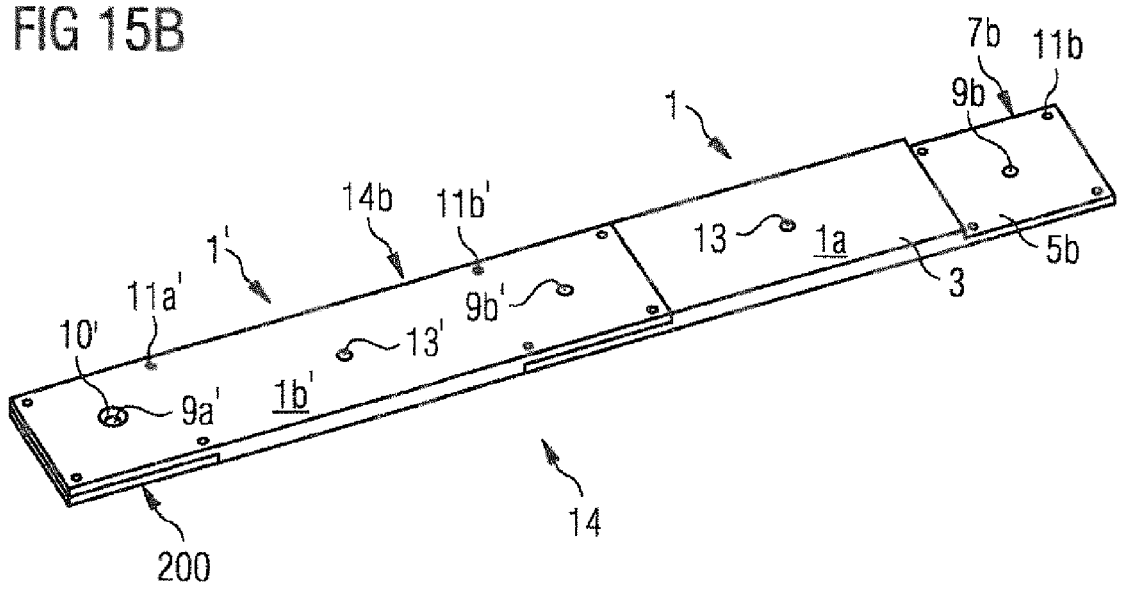

FIGS. 15A and 15B show the upper side 14*a* and the underside 14*b* respectively of a linear holding structure 14 formed from two identical holding bodies 1, 1'. The holding structure 14 further includes a termination piece 200. The termination piece 200 is shown in FIG. 12 and described below in detail.

The holding structure 14 is flat. The upper side 14*a* of the holding structure 14 is formed by the plate underside 1*b* of one holding body 1 and the plate upper side 1*a'* (in particular by the raised surface portion 3') of the other holding body 1' (and by a flat side of the termination piece 200 described below). The plate underside 1*b* of one holding body 1 and the plate upper side 1*a'* of the other holding body 1' lie in a common plane, such that upper side 14*a* of the holding structure is level. The holding structure can be fastened by means of its underside 14*b* to a wall or ceiling via the through-holes 13, 13'. A total of three lampholders 20 can be attached on the holding structure upper side 14*a*, specifically at the two lampholder fastening portions 8*a*, 8*b* of one holding body 1 and at the termination piece 200.

The two holding bodies 1, 1' are mechanically fixedly interconnected at their adjacent longitudinal ends so as to be aligned linearly with one another. To this end, the holding body 1 is placed via the base 5*a* of the cutout formed on the first connection portion 7*a* onto the base 5*b*' of the cutout of the holding body 1' formed on the second connection portion 7*b*', such that the two tabs formed by the cutouts completely overlap and the through-hole 9*a* in one holding body 1 is aligned with the through-hole 9*b*' in the other holding body 1' (see also FIGS. 16A and 16B, which show a right-angled connection of the holding bodies instead of a linear connection, in which the bases 5*a*, 5*b*' are also arranged however so as to completely overlap, but can be better seen). The end face of the holding body 1 (or the end face of the tab 5*a*) bears against the step or against the vertical surface portion of the holding body 1'. Similarly, the end face of the holding body 1' (or the end face of the tab 5*b*') bears against the step or against the vertical surface portion of the holding body 1. On the whole, a form fit at three surface pairs is thus achieved, that is to say at two vertical surface pairs and at one horizontal surface pair.

A screw (not shown) can be screwed into the aligned through-holes 9*a*, 9*b*' in order to fixedly connect the two tabs in a form-fitting and force-fitting manner. The head of the screw, when screwed in, is received in the countersink 10 of the through-hole 9*a*. As already mentioned, the plate underside 1*b* of the holding body 1 and the plate upper side 1*a*' of the holding body 1' are aligned with one another or lie in a common plane and, together with the termination piece 200, form a planar upper side 14*a* of the holding structure 14, on which a total of three lampholders can be fitted at a defined distance from one another.

The termination piece 200 completely fills the cutout formed on the first retaining body connection portion 7*a*' of the retaining body 1', that is to say it is formed in a manner complementary to the cutout. As shown in FIG. 12, the termination piece is square in plan view, corresponding to the shape of the cutouts. The termination piece is formed as a flat plate with level underside and level upper side. Similarly to the retaining body 1, the termination piece 200 may be produced, for example, from metal or a suitable plastic material. The termination piece 200 includes a central through-hole 205, which is aligned with the through-hole 9*a*' in the retaining body 1' when the termination piece 200 is inserted into the cutout. The through-hole 205 has an inner thread. A screw (not shown) can be screwed into the aligned through-holes 9*a*', 205 in order to fixedly connect the termination piece 200 to the retaining body 1' in a form-fitting and force-fitting manner. The head of the screw can be received in the countersink 10'. The termination piece 200 further has four through-holes 207 with inner thread for fastening a lampholder 20, corresponding to the four through-holes 20*a* in the lampholder 20. The thickness of the termination piece 200 is half as large as the thickness of the plate body at the raised portion 3 and is identical to the thickness of the plate body at the tabs.

Figure 16A:
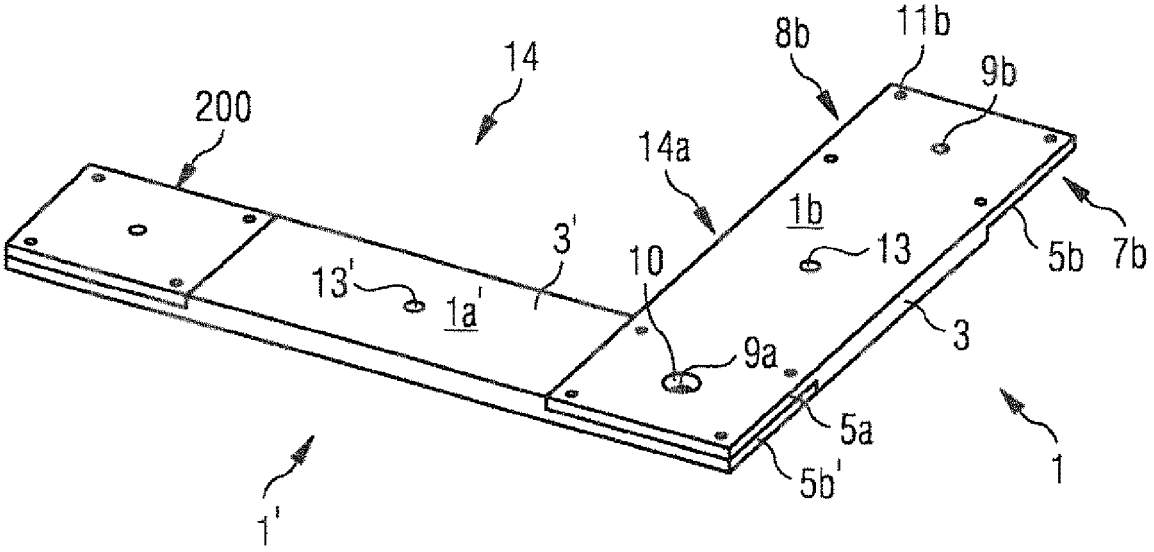
FIGS. 16A and 16B show a plan view and view from below respectively of another/alternative holding structure, which is formed from two holding bodies according to FIGS. 11A and 11B and also from a termination piece according to FIG. 12.
Figure 16B:
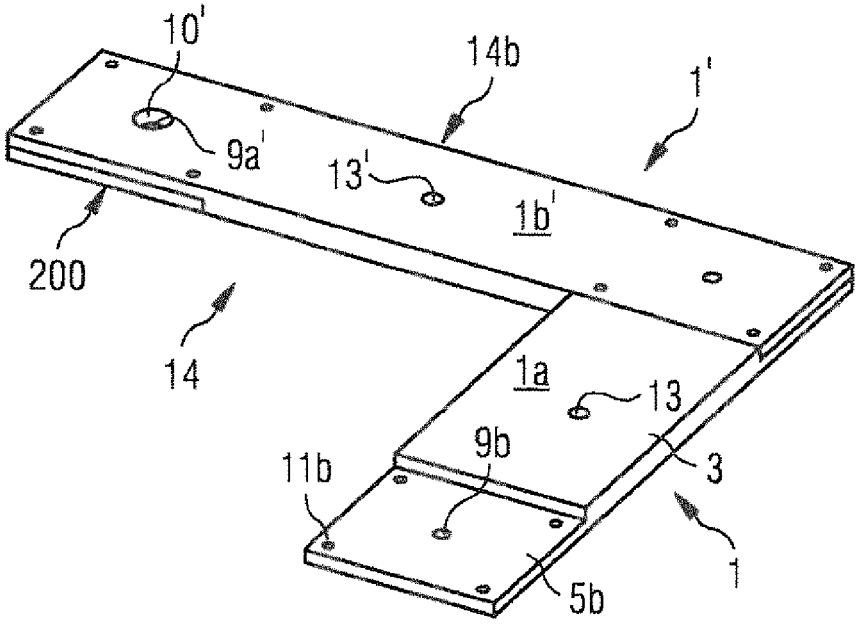

FIGS. 16A and 16B show the upper side 14*a* and underside 14*b* respectively of a right-angled holding structure 14 formed from two identical holding bodies 1, 1' and a termination piece 200. The holding bodies 1, 1' are connected as explained for FIGS. 15A and 15B, with the exception that the two holding bodies are aligned at right angles with respect to one another instead of linearly. The tabs 5*a*, 5*b*' again overlap completely. Here, the holding body 1 bears via a side face (in particular via a side face of the tab 5*a*) against the step or against the vertical surface portion of the holding body 1'. Similarly, the holding body 1' bears via a side face (in particular via a side face of the tab 5*b*') against the step or against the vertical surface portion of the holding body 1, such that a form fit at a total of three surface pairs is again achieved, that is to say at two vertical surface pairs and at one horizontal surface pair. The two holding bodies can be screwed to one another via the aligned through-holes 9*a*, 9*b*'.

In the manner described above with reference to FIGS. 15A, 15B, 16A and 16B, three or even more holding bodies may also be arranged in a row one after the other, aligned and fixedly interconnected, wherein two adjacent holding bodies are always aligned either linearly or at right angles with respect to one another.

Figure 17A:
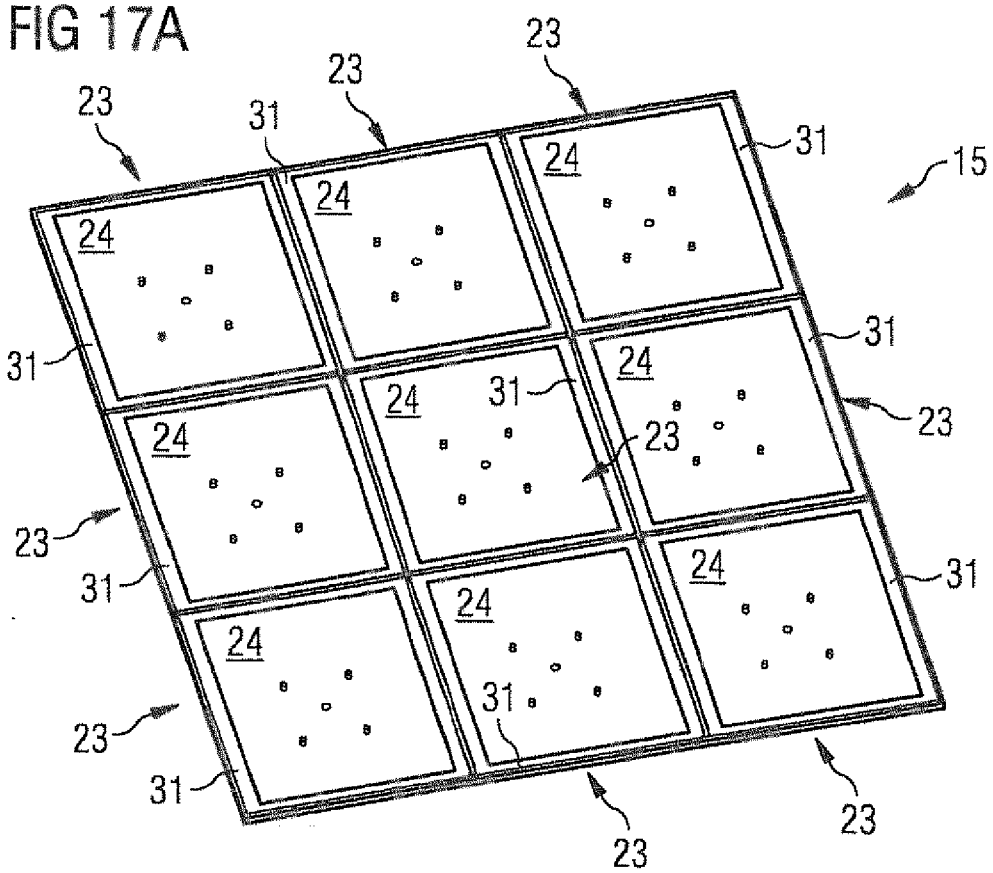
FIGS. 17A and 17B show a plan view and view from below respectively of a luminaire according to the disclosure, which has yet another holding structure, which is formed from eight holding bodies according to FIGS. 11A and 11B and also from a termination piece according to FIG. 12.
Figure 17B:
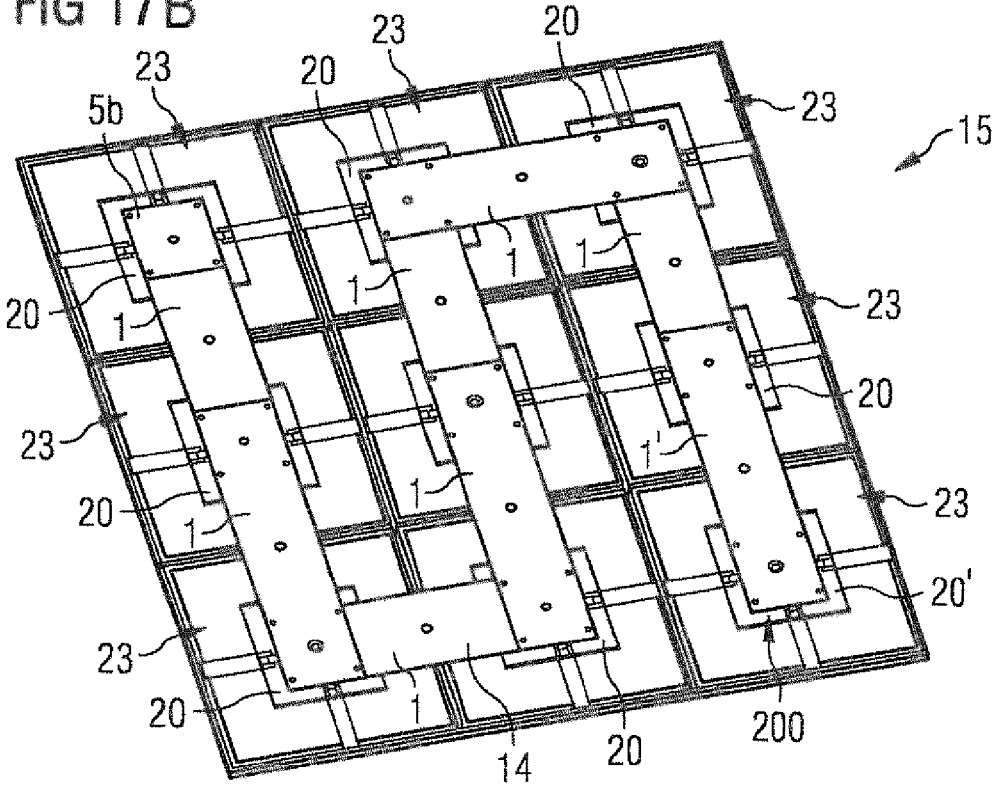

FIG. 17B shows an S-shaped or meandering holding structure 14 formed from eight identical holding bodies and a termination piece 200 in accordance with an embodiment of the disclosure. The termination piece 200 cannot be seen in FIG. 17B, since it is arranged between the right outer holding body 1' and the right outer lampholder 20', that is to say the termination piece 200 is covered in FIG. 17B by the plate underside 1*b*' of the holding body 1'. The holding bodies 1 are fixedly interconnected via their longitudinal ends in a manner oriented either linearly or at right angles with respect to one another, as described above with reference to FIGS. 15A, 15B, 16A and 16B.

A total of nine lampholders 20 are fitted on the upper flat side of the holding structure 14 at regular distances from one another in a number of rows and columns in a matrix-like manner. The distance between the lampholders 20 is determined by the elongate holding bodies 1, that is to say by the lampholder connection portions 8*a*, 8*b* formed on the holding bodies together with the predetermined possibilities for arrangement of the holding bodies relative to one another. In FIG. 17B, two lampholders 20 are fitted on the plate underside of every second holding body 1 at the lampholder connection portions 8*a*, 8*b* thereof (starting with the left-hand outer holding body 1 and the lampholder connection portions 8*a*, 8*b* thereof). The other holding bodies serve here merely for connection of the holding bodies 1 carrying the lampholders 20 at a defined distance and in a defined arrangement, which is achieved by the holding body connection portions 7*a*, 7*b* formed on the holding bodies. The lampholder 20' is fastened to the termination piece 200.

In order to produce the luminaire 15 shown in FIG. 17B, a lamp 23, here a square OLED tile 23, is plugged onto each lampholder 20, such that the respective lampholder 20 is electrically and mechanically connected to the associated OLED tile 23 (for example as described with reference to FIGS. 1 to 10).

As can be seen in FIG. 17A, the luminous areas 24 of the OLED tiles 23 form a common total luminous area of the luminaire 15. The total luminous area is square here. The total luminous area is interrupted merely by the frame 31 of the respective lamp housing and, where applicable, by columns formed between the tiles or lamps 23. The tiles or lamps 23 preferably abut one another directly or almost directly at their periphery, that is to say they are arranged with no distance or only a very short distance from one another. For example, the respective frame 31 can be produced from a transparent material. A continuous total luminous area can therefore be created for the viewer. The respective luminous area 24 may be planar, and the luminous areas 24 may lie in a common plane, such that the total luminous area is likewise planar.

As can further be seen from FIG. 17A, the lampholders 20 are completely covered by the luminous areas 24 in the plugged-on/mounted state of the OLED lamps 23 and are not visible in plan view. In FIG. 17A, the holes or screws received therein are indicated by circles for the purposes of explaining and better understanding of the disclosure. In fact, the holes or screws cannot be seen however in the plan view of the total luminous area, for example as a result of a corresponding design of the rear side of the lamp housing.

Figure 18A:
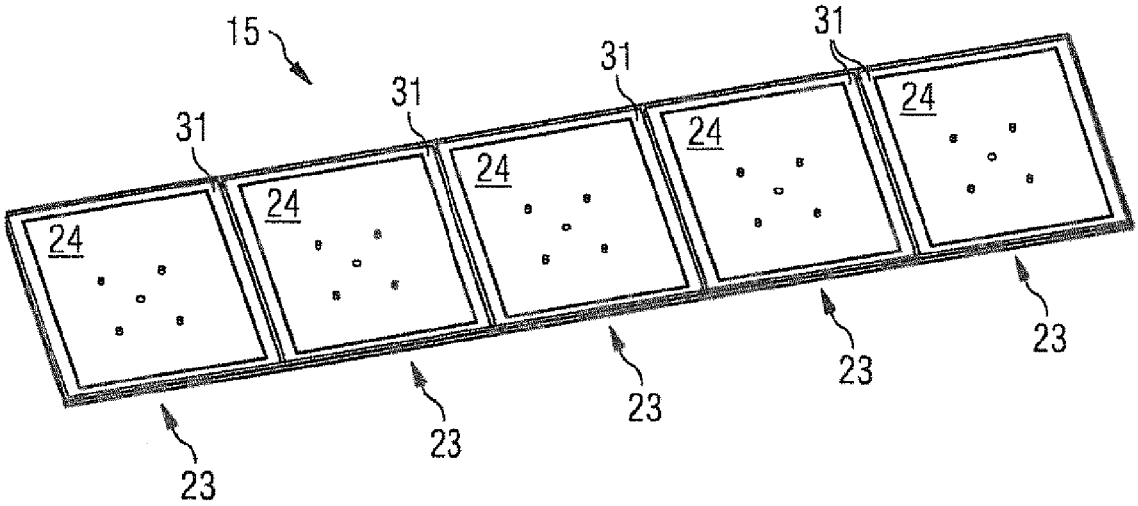
FIGS. 18A and 18B show a plan view and a view from below respectively of another/alternative luminaire according to the disclosure, which has yet another holding structure, which is formed from four holding bodies according to FIGS. 11A and 11B and also from a termination piece according to FIG. 12.
Figure 18B:
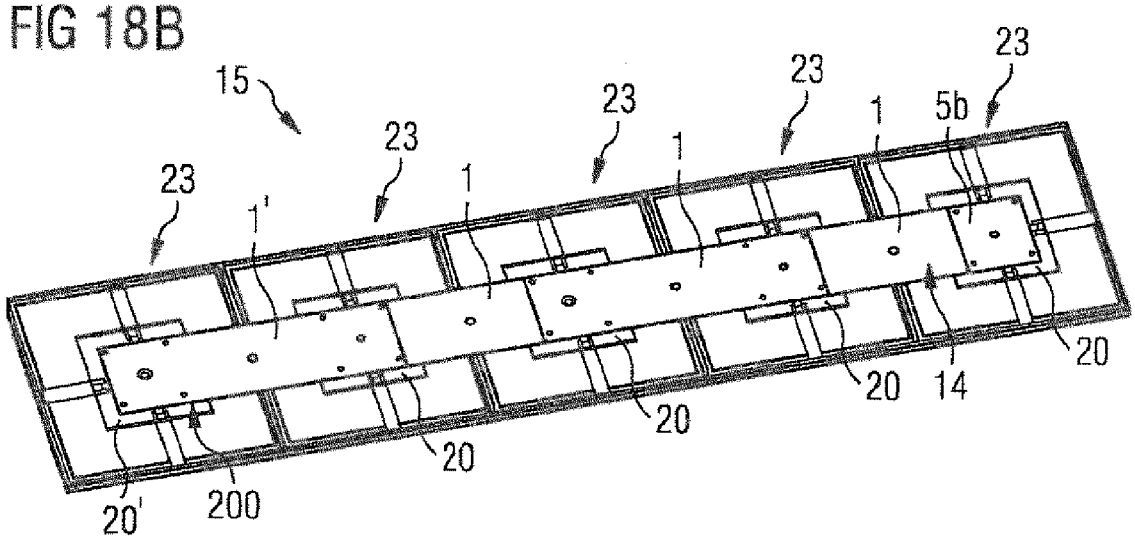

FIG. 18B shows a linear holding structure 14 formed from four identical holding bodies 1 and a termination piece 200. The termination piece 200 cannot be seen in FIG. 18B, since it is arranged between the left-hand outer holding body 1' and the left-hand outer lampholder 20' and is therefore covered by the holding body 1'. FIG. 18A shows the resultant total luminous area of the luminaire 15, that is to say the holding structure 14 together with the lampholders 20 attached thereto, which each hold a lamp 23.

Figure 19A:
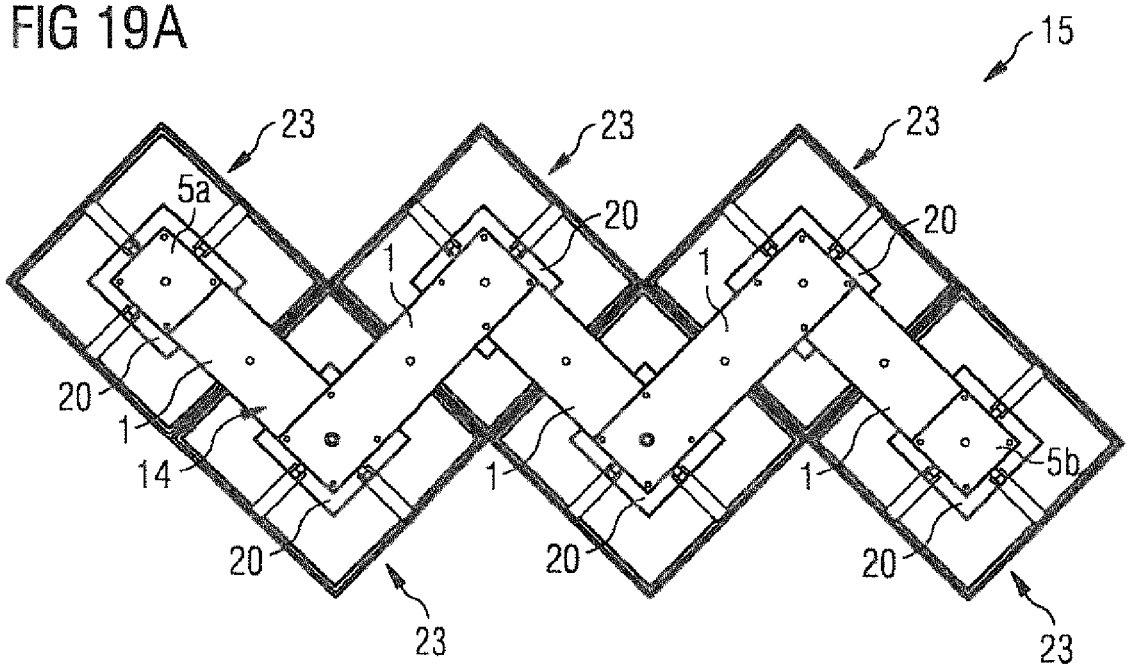
FIGS. 19A and 19B show a view from below and plan view respectively of yet another luminaire according to the disclosure, which has yet another holding structure, which is formed from five holding bodies according to FIGS. 11A and 11B.
Figure 19B:
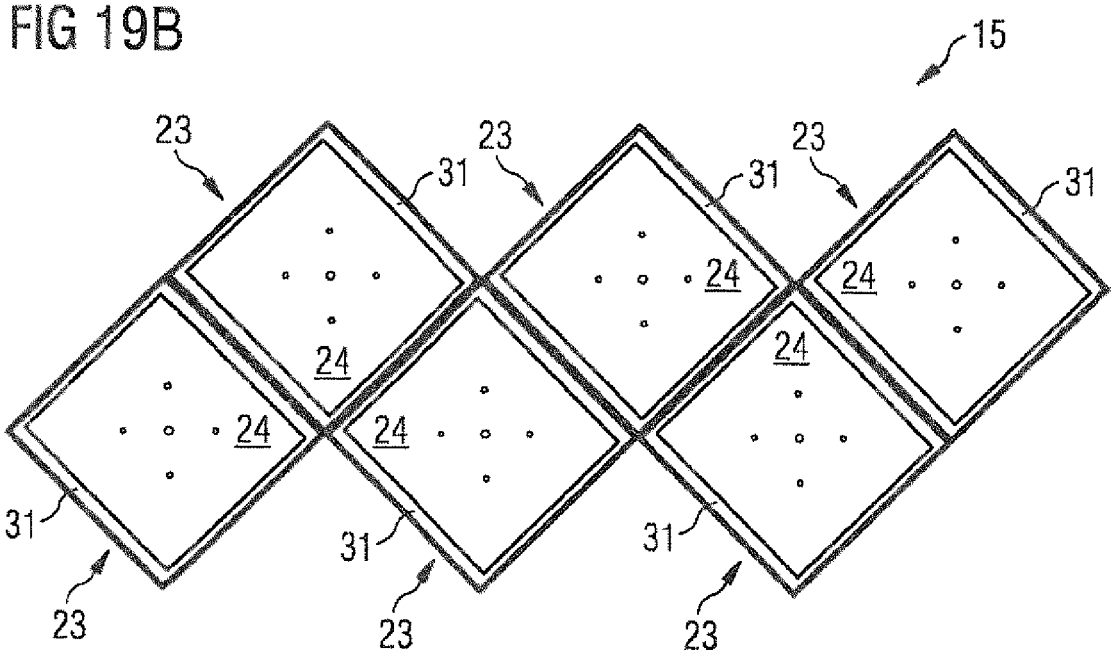

FIG. 19A shows a zigzag-shaped holding structure 14 formed from five identical holding bodies 1. Since the number of holding bodies 1 is odd here, there is no need for a termination piece 200 in order to produce a planar upper flat side of the holding structure 14. A total of six lampholders 20 are fastened to the upper flat side of the holding structure 14. FIG. 19B shows the resultant total luminous area of the luminaire 15, which includes six lamps 23.

Figure 20A:
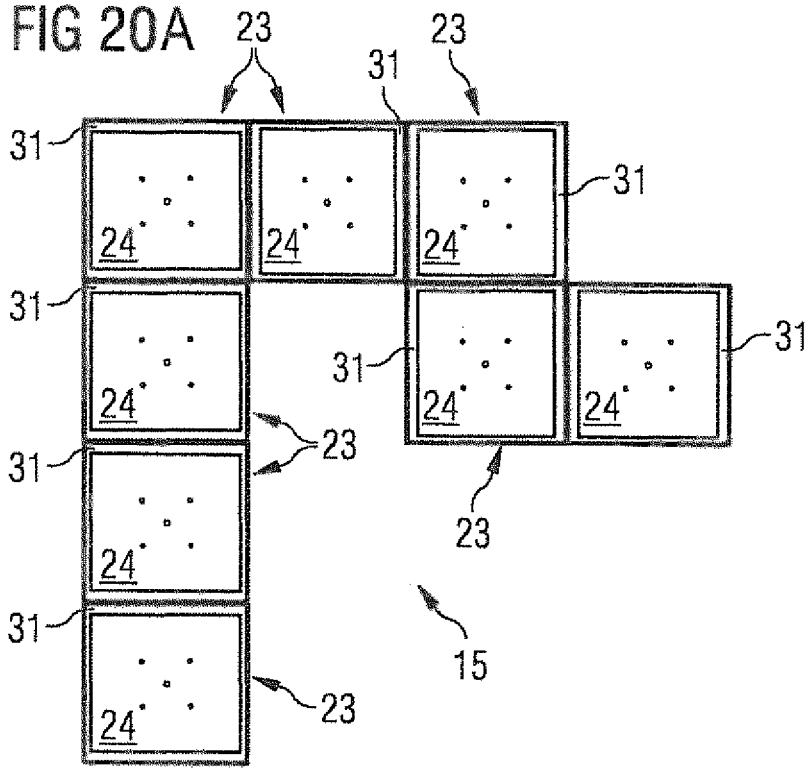
FIGS. 20A and 20B show a plan view and view from below respectively of a further luminaire according to the disclosure, which has a further holding structure, which is formed from seven holding bodies according to FIGS. 11A and 11B.
Figure 20B:
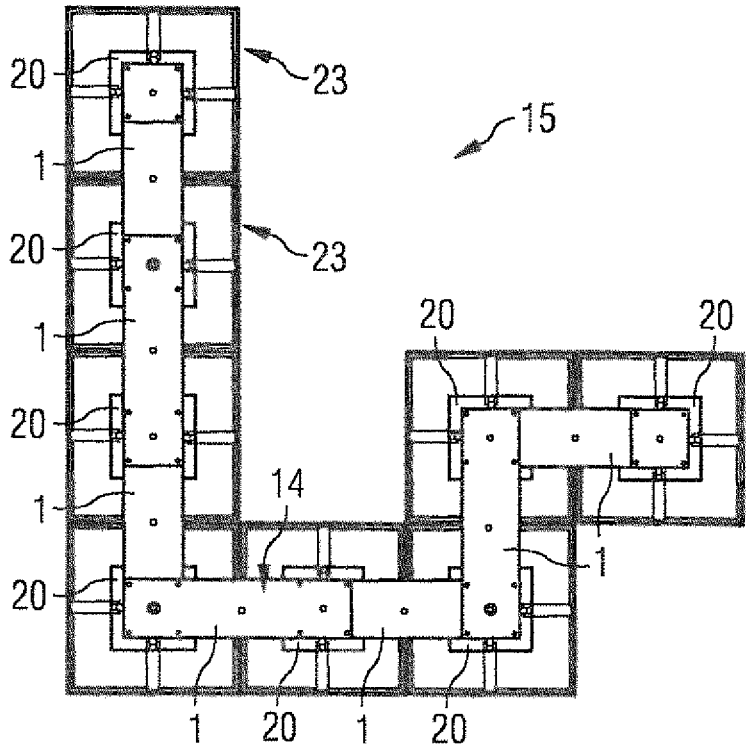

FIG. 20B shows a serpentine holding structure 14 formed from seven identical holding bodies 1, a total of eight lampholders 20 being fastened in succession to the upper flat side of said holding structure at a constant distance from one another. Since the number of holding bodies 1 is odd here and the number of lampholders 20 is even, again, there is no need for a termination piece 200. FIG. 20B shows the resultant total luminous area of the luminaire 15, which includes eight lamps 23.

As shown in the figures, different holding structures 14 can be produced with a plurality of holding bodies 1, which are each formed as shown in FIGS. 11A and 11*b*, it still being possible to reliably fit the lampholders on the holding structures with the necessary or desired spacing. As a result, different luminaire structures can be produced without difficulty, in which the lamps 23 are aligned with one another expediently. This can additionally be achieved with low production costs, since the holding bodies, lampholders and illuminant can each be formed identically.

As mentioned above, other lampholders and/or other lamps can also be used with the holding bodies 1 from FIGS. 11A and 11B, for example lamps that are circular in plan view. The middle plate portion in the longitudinal direction may then be tapered, for example.

Also, not all holding bodies have to be completely identical. At least a plurality of the holding bodies may then be identical however. Furthermore, at least the end portions of the holding bodies may be identical. A set of different holding bodies may be necessary, for example, for a luminaire 15 as shown in FIG. 1. This luminaire includes nine lampholders 20, to which nine rectangular OLED tiles 23 are fastened. Here, six identical holding bodies of a first length and two identical holding bodies of a second length may be used. The longitudinal ends of all holding bodies may be identical, that is to say the holding body connection portions and lampholder connection portions formed on the holding bodies may be identical.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

LIST OF REFERENCE SIGNS

1 holding body
1*a* holding body upper side
1*b* holding body underside
3 raised portion
5*a* base of the cutout
5*b* base of the cutout
7*a* holding body connection portion
7*b* holding body connection portion
8*a* lampholder fastening portion
8*b* lampholder fastening portion
9*a* through-hole in the holding body connection portion
9*b* through-hole in the holding body connection portion
10 countersink
11*a* through-hole in the lampholder connection portion
11*b* through-hole in the lampholder connection portion
13 through-hole
14 holding structure
14*a* holding structure upper side
14 holding structure underside
15 luminaire
16 supply line
17 voltage source
18 switch
20 lampholder
20*a* through-hole in lampholder
21 row
22 column
23 illuminant
24 luminous area of 23
25 carrier element
26 front plate or film
27 rear plate or sheet
30 illuminant housing
31 frame
32 housing rear wall
33 light exit opening
34 web
35 bearing surface
36 web portion
39 illuminant contact part
40 illuminant contact
41 contact point
42 contact tongue
42*a* level portion of 42
42*b* free end of 42
43 slot
44 first end of 39
45 second end of 39
46 illuminant attachment point
47 crosspiece
48 contact wing
49 bend point
51 holding portion of 39
52 holding clamp
53 bend
54 clamping tongue
55 holding opening
56 holding protrusion
57 spring zone
58 tongue holding part
59 spring tongue
60 bearing element

63 receiving region
64 inner face of 32
65 illuminant attachment point opening
66 rear side
67 detent lug
68 frame cheek
70 illuminant connection device
71 detent means
72 detent protrusion
73 detent bulge
74*a* inclined surface of 73
74*b* detent bearing surface of 73
75 cutout
76 supply channel
77 base
78 cable of 16
79 stiffening rib
80 coding element
90 lampholder housing
91 housing shells
92 corner of 90
93 lampholder housing side
94 supply attachment point region
95 supply attachment point
96 attachment point cutout
97 clamping sides
98 middle side portion
99 attachment point opening
100 clamping web
103 strain relief means
104 screw
105 inner thread
106 clamping element
107 insertion protrusion
108 insertion slot
109 clamping edge
110 detent hook
114 attachment point surface
115 attachment point clamp
116 short-circuit connector
117 lampholder connection
118 base portion
119 aperture
120 connection tongue
121 deflection point
122 connection part
125 attachment point clamping body
126 middle piece
127 support part
128 support protrusion
130 lampholder attachment device
131 connection side
132 mounting side
133 detent edge
134 lampholder housing opening
135 lampholder attachment point opening
200 termination piece
201 termination piece upper side
203 termination piece underside
205 through-hole for fasting the termination piece to the holding body
207 through-hole for fastening the lampholder to the termination piece
E direction of insertion
M center point of 23
P center point of 20

The invention claimed is:

1. A luminaire, comprising:

a plurality of flat surface-light lamps having a respective upper flat side, which comprises a luminous area, and a respective underside, which is arranged opposite the upper flat side, a plurality of lampholders, wherein each of the plurality of lampholders mechanically holds and electrically contacts respectively a respective one of the plurality of flat surface-light lamps and wherein the respective underside of each flat-surface light lamp is mechanically and electrically connected to the respective lampholder, and a plurality of integrally formed elongated holding bodies, each of which comprising two longitudinal ends and at least one holding body connection portion at one of the longitudinal ends, wherein the holding body connection portion matches with another holding body connection portion of another holding body, and wherein the plurality of holding bodies are mechanically fixedly interconnected to each other via the matching holding body connection portions, wherein at least one longitudinal end of one of the plurality of elongated holding bodies is stacked on a longitudinal end of another one of the plurality of elongated holding bodies, and the plurality of elongated holding bodies are mechanically fixedly interconnected so as to form a holding structure, wherein the lampholders are fitted at regular distances from one another on a common holding structure side of the holding structure wherein at least one lampholder of the plurality of lampholders is arranged on the one of the plurality of elongated holding bodies and another lampholder of the plurality of lampholders is arranged on the another one of the plurality of elongated holding bodies.

2. The luminaire as claimed in claim 1, wherein the respective flat surface-light lamp is an illuminant, which comprises:

a plate-like or sheet-like carrier element, which carries a semiconductor luminous element or is part of a semiconductor luminous element, and an illuminant housing, in which the carrier element is received and which, on its front side, comprises a light exit opening for radiating light and which, on its rear side opposite the front side, comprises an illuminant connection device for establishing a mechanical and electrical connection to the associated lampholder.

3. A set for a luminaire comprising:

a plurality of lampholders, wherein each of the plurality of lampholders is formed for mechanically holding and electrically contacting respectively a respective flat surface-light lamp, and a plurality of integrally formed elongated holding bodies, each of which comprising two longitudinal ends and at least one holding body connection portion at one of the longitudinal ends, wherein the holding body connection portion matches with another holding body connection portion of another holding body, and wherein the plurality of holding bodies are mechanically fixedly interconnectable or mechanically fixedly interconnected to each other via the matching holding body connection portions formed on the longitudinal ends of the holding bodies, wherein at least one longitudinal end of one of the plurality of elongated holding bodies is stacked or stackable on a longitudinal end of another one of the plurality of elongated holding bodies so as to form a holding structure, wherein the holding structure is composed of the holding bodies and to which the lampholders are fitted at regular distances from one another on a common holding structure side wherein at least one lampholder of the plurality of lampholders is arranged on the one of the plurality of elongated holding bodies and another lampholder of the plurality of lampholders is arranged on the another one of the plurality of elongated holding bodies.

4. The luminaire as claimed in claim 1, wherein the lampholders are formed as separate components from the holding bodies, which each comprise a lampholder housing, wherein the respective lampholder housing comprises a connection side, on which a lampholder attachment device is provided, which serves to establish a mechanical and electrical connection to an associated surface-light lamp, and wherein the respective lampholder housing further comprises a mounting side opposite the connection side for fastening the lampholder to the holding structure.

5. The luminaire as claimed in claim 4, wherein the respective lampholder is formed as a flat component, the two flat sides of which form the connection side and the mounting side.

6. The luminaire as claimed in claim 1, wherein the elongated holding bodies or at least the longitudinal ends thereof are identical.

7. The luminaire as claimed in claim 1, wherein the elongated holding bodies are detachably interconnected or can be detachably interconnected at their longitudinal ends.

8. The luminaire as claimed in claim 1, wherein the elongated holding bodies are interconnected or interconnectable in a form-fitting manner at their longitudinal ends via engagement portions formed in a complementary manner.

9. The luminaire as claimed in claim 1, wherein two adjacent holding bodies are connected or connectable in either a linear or right-angled arrangement relative to one another.

10. The luminaire as claimed in claim 1, wherein the elongated holding bodies are formed as flat plate bodies with a plate underside and a plate upper side.

11. The luminaire as claimed in claim 10, wherein the respective plate underside is formed in a planar manner.

12. The luminaire as claimed in claim 10, wherein one or more holes for fastening a lampholder are formed on the plate underside of one or more or all plate bodies at the two longitudinal ends, and wherein the lampholders are fitted or can be fitted to the plate undersides with use of fastening elements, which extend through corresponding through-holes in the lampholders and into the respective hole on the plate underside.

13. The luminaire as claimed in claim 10, wherein a cutout is formed on the respective plate upper side on the respective longitudinal end and extends over the entire plate width from the respective longitudinal end in the direction of the center of the plate.

14. The luminaire as claimed in claim 13, wherein at least one through-hole is formed in the base of the respective cutout, and wherein two adjacent holding bodies are interconnected or can be interconnected with the bases of their cutouts placed one above the other and with use of a fastening means, which extends through the two aligned through-holes.

15. A holder element for holding at least one flat surface-light lamp, comprising:

an elongated, flat plate body having an upper plate side and a lower plate side arranged opposite the upper plate side, and one or more lampholders, wherein each lampholder can be fitted or is fitted on the plate body and is formed for mechanically holding and electrically contacting respectively a respective flat surface-light lamp, wherein an engagement portion is formed on each of the two longitudinal ends of the plate body and is formed by a cutout, which extends, in plan view, from the respective longitudinal end of the plate body over the entire width of the plate body in the direction toward the longitudinal center, such that the plate body can be connected at each of its two longitudinal ends to another, identically formed plate body so as to form a form-fitting connection formed by the engagement portions of the adjacent plate bodies.

16. The set as claimed in claim 3, wherein the lampholders are formed as separate components, which each comprise a lampholder housing, wherein the respective lampholder housing comprises a connection side, on which a lampholder attachment device is provided, which serves to establish a mechanical and electrical connection to an associated surface-light lamp, and wherein the respective lampholder housing further comprises a mounting side opposite the connection side for fastening the lampholder to the holding structure.

17. The set as claimed in claim 16, wherein the respective lampholder is formed as a flat component, the two flat sides of which form the connection side and the mounting side.

18. The set as claimed in claim 3, wherein the elongated holding bodies or at least the longitudinal ends thereof are identical.

19. The set as claimed in claim 3, wherein the elongated holding bodies are detachably interconnected or can be detachably interconnected at their longitudinal ends.

20. The set as claimed in claim 3, wherein the elongated holding bodies are interconnected or interconnectable in a form-fitting manner at their longitudinal ends via engagement portions formed in a complementary manner.

* * * * *